US010338489B2

(12) United States Patent
Kadonome et al.

(10) Patent No.: US 10,338,489 B2
(45) Date of Patent: Jul. 2, 2019

(54) TWO-COMPONENT DEVELOPER AND IMAGE FORMING METHOD USING THE SAME

(71) Applicant: Konica Minolta, Inc., Tokyo (JP)

(72) Inventors: Futoshi Kadonome, Sagamihara (JP); Keiji Arai, Higashimurayama (JP); Junichi Furukawa, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/976,151

(22) Filed: May 10, 2018

(65) Prior Publication Data

US 2018/0364602 A1 Dec. 20, 2018

(30) Foreign Application Priority Data

Jun. 20, 2017 (JP) ..... 2017-120773

(51) Int. Cl.
*G03G 9/08* (2006.01)
*G03G 9/113* (2006.01)
*G03G 9/087* (2006.01)

(52) U.S. Cl.
CPC ..... *G03G 9/1138* (2013.01); *G03G 9/0819* (2013.01); *G03G 9/0825* (2013.01); *G03G 9/08711* (2013.01); *G03G 9/08728* (2013.01); *G03G 9/08755* (2013.01); *G03G 9/08797* (2013.01); *G03G 9/1139* (2013.01)

(58) Field of Classification Search
CPC ..... G03G 9/1138; G03G 9/1139
USPC ..... 430/108.7
See application file for complete search history.

(56) References Cited

U.S. PATENT DOCUMENTS 5,922,499 A * 7/1999 Wilson ..... G03G 9/09733 430/108.21

FOREIGN PATENT DOCUMENTS

JP 2007219118 A 8/2007
JP 2014035506 A 2/2014

* cited by examiner

*Primary Examiner* — Mark A Chapman
(74) *Attorney, Agent, or Firm* — Lucas & Mercanti, LLP

(57) ABSTRACT

The present invention provides a two-component developer for developing an electrostatic charge image, which includes a toner and a carrier, wherein the toner contains an amorphous resin and a crystalline resin as binder resins and an inorganic particle as external additive particle, and the carrier has a surface to which silica particles having a number average particle diameter of 10 to 30 nm are attached in an amount in the range of the following Equation (1): 5 at %≤S1≤10 at %, wherein S1 represents a concentration of Si element as measured by XPS and indicates an amount of silica on the surface of the carrier.

6 Claims, 1 Drawing Sheet

TWO-COMPONENT DEVELOPER AND IMAGE FORMING METHOD USING THE SAME

CROSS-REFERENCE TO RELATED APPLICATION

The entire disclosure of Japanese Patent Application No. 2017-120773, filed on Jun. 20, 2017, is incorporated herein by reference in its entirety.

BACKGROUND

1. Technological Field

The present invention relates to a two-component developer for developing an electrostatic charge image, containing at least a toner and a carrier, and an image forming method using the same.

2. Description of the Related Art

Recently, in image output using an electrophotographic process, low-temperature fixation of a toner has been advanced for the purpose of meeting higher speed, higher image quality, and energy saving. Low-temperature fixability of the toner has been realized by a technology of introducing a crystalline resin into a non-crystalline resin (also referred to as an amorphous resin) to impart a sharp-melting property to a binder resin. For example, in order to simultaneously achieve low-temperature fixability and heat-resistant storage property, there has been proposed a technology capable of attaining excellent heat resistance without deteriorating low-temperature fixability by using an amorphous vinyl polymer and a crystalline resin and specifying a content of the amorphous vinyl polymer (see JP 2014-035506 A).

On the other hand, in order to obtain a two-component developer capable of ensuring a stable image quality over a long period of time, a two-component developer using a toner having a small particle diameter and a carrier pre-treated with titanium oxide has been proposed (for example, see JP 2007-219118 A).

SUMMARY

However, it has been found that in a developer using the low-temperature fixable toner containing the crystalline resin as disclosed in JP 2014-035506 A and the carrier pre-treated with titanium oxide as disclosed in JP 2007-219118 A, a charge amount is decreased after long-term storage, which caused a problem of image quality deterioration at an initial stage of use. The reason therefor may be that a charge holding ability of the crystalline resin is low and a charge holding ability of titanium oxide is low.

Therefore, an object of the present invention is to provide a two-component developer capable of stably outputting a high-quality image for a long period of time from an initial stage of use while maintaining a charge amount for a long period of time immediately after preparing the developer which uses a toner containing a crystalline resin having excellent low-temperature fixability, and an image forming method using the same.

The present inventors have conducted intensive studies in view of the above-mentioned object. As a result, the present inventors have found that in the developer using a toner containing a crystalline resin having excellent low-temperature fixability, the above-mentioned object could be achieved by using an appropriate amount of silica particles having higher resistance than that of titanium oxide in the carrier pre-treatment to prevent recombination of charges on a toner side and a carrier side. By this, the present invention has been completed.

To achieve at least one of the abovementioned objects, according to an aspect of the present invention, a two-component developer for developing an electrostatic charge image reflecting one aspect of the present invention includes a toner and a carrier, wherein the toner contains an amorphous resin and a crystalline resin as binder resins and an inorganic particle as an external additive particle, and the carrier has a surface to which silica particles having a number average particle diameter of 10 to 30 nm are attached in an amount in the range of the following Equation (1).

$$5 \text{ at } \% \leq S1 \leq 10 \text{ at } \% \quad (1)$$

(wherein S1 represents a concentration of Si element as measured by XPS and indicates an amount of silica on the surface of the carrier).

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
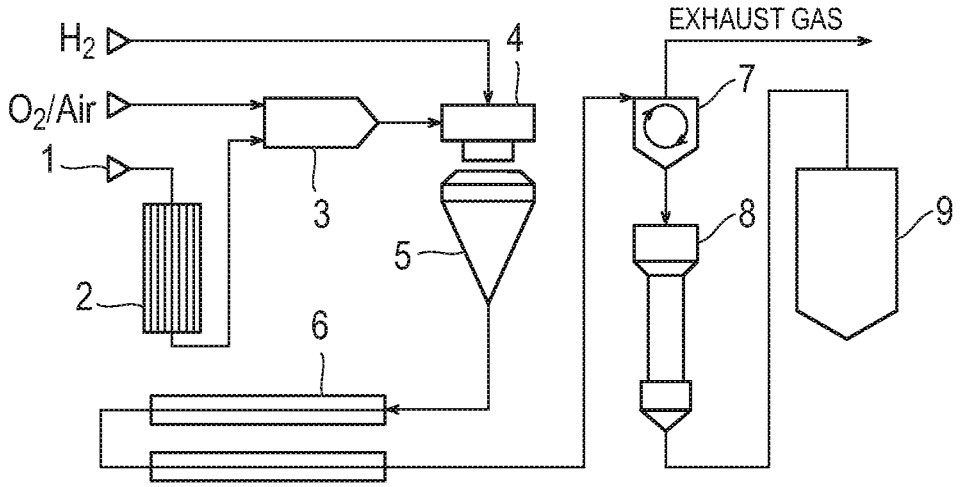
FIG. 1 is a schematic view illustrating an example of a preparation facility for preparing silica particles by a vapor phase method using vapor, wherein reference numeral 1 denotes a raw material inlet, reference numeral 2 denotes an evaporator, reference numeral 3 denotes a mixing chamber, reference numeral 4 denotes a combustion burner, reference numeral 5 is a reaction chamber, reference numeral 6 is a cooler, reference numeral 7 is a separator, reference numeral 8 is a treating chamber, and reference numeral 9 is a silo.

Hereinafter, one or more embodiments of the present invention will be described with reference to the drawings. However, the scope of the invention is not limited to the disclosed embodiments. In the description of the drawings, the same elements are denoted by the same reference numerals, and redundant description is omitted. In addition, in some cases, dimensional ratios in the drawings are exaggerated and different from actual ratios for convenience of the description. Furthermore, in the present specification, "X to Y" indicating a range means "X or more and Y or less". In addition, unless otherwise specified, operation and measurements of physical properties, and the like, are performed at room temperature (20 to 25° C.)/relative humidity of 40 to 50% RH.

[1] Two-Component Developer

A first embodiment of the present invention relates to a two-component developer for developing an electrostatic charge image, containing at least a toner and a carrier (hereinafter, simply referred to as a developer or a starter developer), wherein the toner contains at least an amorphous resin and a crystalline resin as binder resins and an inorganic particle(s) as an external additive particle, and the carrier has a surface to which silica particles having a number average particle diameter of 10 to 30 nm are attached in an amount in the range of the following Equation (1). The developer according to the present invention, which has the above-mentioned configuration, has excellent low-temperature fixability, and can maintain a charge amount for a long period of time immediately after preparing the developer. In addition, it is possible to stably output a high-quality image for a long period of time after using the developer. Here, a developer mounted in an image forming apparatus such as a copying machine is referred to as a "starter developer", and includes a fresh one replaced for a developer which exceeded the durability thereof by a service man. Meanwhile, recently, there is a case where a carrier is mixed with a replenishment toner in order to improve durability of a developer, and in this case, the developer is referred to as a replenishment developer. In general, the starter developer has a toner concentration of about 5 to 10% by mass, but the replenishment developer has a toner concentration of 70 to 95% by mass and is composed of a small amount of carrier and a large amount of toner.

$$5 \text{ at } \% \leq S1 \leq 10 \text{ at } \% \quad (1)$$

In the Equation (1), S1 represents a concentration of Si element as measured by XPS and indicates an amount of silicon (Si) on the surface of the carrier.

The reason why the above-mentioned effects can be obtained by the developer according to the present invention, and the mechanism of expression or mechanism of action thereof are not clear, but estimated as follows.

There is a technology capable of obtaining excellent heat resistance without deteriorating low-temperature fixability by using an amorphous vinyl polymer and a crystalline resin (crystalline polyester resin) and specifying a content of the amorphous vinyl polymer in order to simultaneously achieve low-temperature fixability and a heat-resistant storage property (see JP 2014-035506 A). The present inventors have thought of effectively utilizing a technology relating to the toner containing a crystalline resin in order to achieve such low-temperature fixability.

Meanwhile, it has been found that in view of maintaining chargeability of a developer for a long period of time, an initial charge amount cannot only be adjusted but also chargeability during long-term storage can be maintained, by adjusting an amount of silica particles existing on a carrier particle surface.

The reason therefor may be as follows.

The two-component developer is charged by contact friction mixing between a carrier and a toner. A level of charge amount of the carrier can be adjusted by attaching an external additive to a surface of the carrier in advance to allow the external additive to apparently migrate to the carrier (preparation of a starter developer). Particularly, it is easy to adjust an initial charge amount. The reason therefor is that at the beginning, the carrier is not contaminated by a component of the toner and thus a charge imparting ability thereof is high, while during the use period (operation of image forming apparatus), the external additive gradually migrates from the toner to the surface of the carrier to gradually decrease a charge amount. The reason therefor is also that it is impossible to suppress an increase in the charge amount simply by promoting migration of the external additive from the toner at the time of contact friction mixing.

It has been found that when a carrier pre-treated with titanium oxide (titania) was used in the starter developer (see JP 2007-219118 A), a charge amount after long-term storage was decreased. The reason therefor may be that negative charges are generated on a toner side and positive charges are generated on a carrier side, respectively, and first, the respective charges are maintained, but since resistance of titanium oxide is low, negative charges generated on the toner side and the positive charges generated on the carrier side are recombined with each other, and thus, charges disappear.

Therefore, when the developer is stored for a long period of time after being prepared, a charge gradually disappears, and a charge amount as the starter developer is decreased. Particularly, it has been found that in a toner containing a crystalline resin for low-temperature fixability (see JP 2014-035506 A), the above-mentioned tendency was more remarkable due to low resistance of a toner base particle. In the case where an external additive such as titania having low resistance is attached to a carrier, since the presence of an external additive particle which migrates to a toner side can induce decrease in chargeability of the toner itself. Therefore, when a developer after the long-term storage is filled and stirred in a developing device in an image forming apparatus, a charge amount cannot be recovered to a desired level, to occur image failure.

By using a silica particle having higher resistance than that of the titanium oxide in the pre-treatment of a carrier, recombination of charges on the toner side and the carrier side can be prevented, a charge amount after long-term storage can be maintained, and a charge amount can be maintained even after preparing a developer. Since a silica particle has more excellent dispersibility than that of another inorganic particle, as well as higher volume resistance and more excellent charge retention ability as compared to an inorganic particle such as a titanium oxide and alumina particle used in a toner, the silica particle can be more uniformly dispersed on the surface of a carrier, such that chargeability of the carrier can be made uniform. Since an organic particle deteriorates in fluidity as a developer, the organic particle is not preferable. Further, silica particles (particularly, hydrophobic silica particles) having a relatively small particle diameter as of a number average particle diameter of 10 to 30 nm can be densely dispersed on the surface of the carrier, and are hardly affected by an environment caused by a change in humidity. Therefore, the developer has improved long-term storage property. Particles larger than 30 nm are not preferable in that particles attached to the surface of the carrier migrate to the toner side. Further, in the case of particles smaller than 10 nm, at the time of pre-treatment, the particles themselves are not disintegrated but form an aggregate. In this case, particles to be primarily attached to the surface of the carrier migrate to the toner side, which is not preferable.

An initial pre-treatment level of the carrier (amount of silica on the surface of the carrier as a concentration of Si element as measured by XPS) is 5 at % to 10 at % in view of adjustment of a charge level and suppression of free silica particles.

As described above, by adjusting an amount of silica particle(s) having a predetermined particle diameter existing on the surfaces of the carrier particle in advance even in a developer using a toner containing a crystalline resin having excellent low-temperature fixability, an initial charge amount can be adjusted, and chargeability during the long-term storage can be maintained, such that the above-mentioned effect can be obtained.

It should be noted that the mechanism is based on speculation, and the present invention is not limited to the mechanism described above.

Hereafter, the two-component developer according to the present invention will be described in detail. The two-component developer according to the present invention contains at least the toner and the carrier. Here, the toner contains a "toner base particle". The "toner base particle" is converted to a "toner particle" when an external additive is externally added (attached) to a surface thereof. In addition, the "toner" refers to an aggregate of the "toner particles". Hereinafter, the toner and the carrier will be separately described.

<Toner>

[Toner Base Particle]

The toner base particle constitutes a base of the toner particle. The toner base particle according to the present invention has preferably a domain-matrix structure, and the toner base particle contains at least a binder resin as a constituent component, and if necessary, may contain another constituent component (internal additive) of toner such as a colorant, a release agent (wax), and a charge control agent.

A preparation method of the toner base particle according to the present invention is not particularly limited, but may be a dry method. However, a wet preparation method (for example, an emulsion aggregation method, or the like) in which the toner base particle is prepared in an aqueous medium is more preferable.

<Binder Resin (Amorphous Resin and Crystalline Resin)>

The toner base particle according to the present invention contains an amorphous resin and a crystalline resin as binder resins. In addition, the toner (toner base particle) has preferably a domain-matrix structure formed by dispersing a domain phase containing the crystalline resin in a matrix phase containing the amorphous resin. By allowing the toner base particles to have the domain-matrix structure, charge amount can be maintained even in the case of using a crystalline resin.

Here, the "domain-matrix structure" is referred to a structure in which a domain phase having a closed interface (a boundary between phases) exists in a continuous matrix phase. It is preferable that the toner according to the present invention has a domain-matrix structure, and the matrix contains the amorphous resin, and the domain contains a crystalline polyester resin. In the toner having the above-mentioned structure, there is a portion in which the crystalline polyester resin is introduced in an incompatible state in the amorphous resin. Further, in the toner having the above-mentioned structure, as a difference in the carbon number between an alcohol and an acid of the crystalline polyester resin increases, aggregation of the crystalline polyester resin is further suppressed, such that the crystalline resin can be finely dispersed. Preferably, a difference in the carbon number between an alcohol monomer and an acid monomer is in the range of 5 to 12. When the difference is 5 or more, it is possible to prevent an excessively large domain from being formed, and when the difference is 12 or less, it is possible to prevent an excessively small domain from being formed. In addition, the domain may also contain a lamellar crystal structure, and a release agent (wax), or the like, may be added to the domain in addition to the crystalline resin.

The domain-matrix structure can be observed by the following method. A domain-matrix structure of a toner prepared in Examples to be described below was also observed by the following method.

Device: electron microscope "JSM-7401F" (manufactured by JEOL Ltd.)

Sample: Toner slice dyed with ruthenium tetroxide ($RuO_4$) (slice thickness: 60 to 100 nm)

Acceleration voltage: 30 kV

Magnification: 50,000 folds

Observation condition: Transmission electron detector, bright field image.

The sample (dyed toner slice) is prepared as follows.

1 to 2 mg of a toner is spread in a 10 mL sample bottle, treated under ruthenium tetroxide ($RuO_4$) vapor dyeing condition as described below, dispersed in a photocurable resin "D-800" (manufactured by JEOL Ltd.), and then photo-cured, thereby forming a block. Then, an ultra-thin plate shaped sample having a thickness of 60 to 100 n is cut out from the block using a microtome provided with a diamond knife. Thereafter, the cut sample is treated again under the following ruthenium tetroxide treatment conditions and dyed.

The ruthenium tetroxide treatment conditions are as follows.

The ruthenium tetroxide treatment is performed using a vacuum electron dyeing apparatus VSC1R1 (manufactured by Filgen Inc.). According to a procedure of the apparatus, after a sublimation chamber containing ruthenium tetroxide is installed in a main body of the dyeing apparatus, and a toner or ultra-thin slice is introduced into a dyeing chamber, and treated at room temperature (24 to 25° C.) and in a concentration of 3 (300 Pa) for 10 minutes as ruthenium tetroxide dyeing conditions.

The obtained sample is observed as follows.

Within 24 hours after dyeing, the sample is observed with the electron microscope "JSM-7401F" (manufactured by JEOL Ltd.).

[Amorphous Resin]

The amorphous resin contained in the toner according to the present invention constitutes the binder resin together with the crystalline resin. The amorphous resin is referred to a resin having no melting point and a relatively high glass transition temperature (Tg) when performing differential scanning calorimetry (DSC) on the resin.

When a glass transition temperature in a first heating process in DSC measurement is $Tg_1$ and a glass transition temperature in a second heating process is $Tg_2$. $Tg_1$ of the amorphous resin is preferably 35 to 80° C. and more preferably 45 to 65° C. When $Tg_1$ is within the above-mentioned range, fixability such as low-temperature fixability and heat resistance such as a heat-resistant storage property and blocking resistance can be clearly obtained. Further, for the similar reason (in similar viewpoints), $Tg_2$ of the amorphous resin is preferably 20 to 70° C., and particularly preferably 30 to 55° C.

A content of the amorphous resin is not particularly limited, but in view of image intensity, the content of the amorphous resin is preferably 20 to 99% by mass relative to a total amount of the toner base particle. In addition, the content of the amorphous resin is more preferably 30 to 95% by mass, and particularly preferably 40 to 90% by mass relative to a total amount of the toner base particle. In the case where two or more kinds of resins are contained as the amorphous resins, a sum of contents of these resins is preferably within the above-mention range relative to a total amount of the toner base particle. Even when an amorphous resin containing a release agent is used, a content of the release agent in the amorphous resin containing the release agent is included in a content of the release agent constituting the toner.

The amorphous resin used in the toner base particle according to the present invention, preferably, the amorphous resin constituting the matrix is not particularly limited, and existing amorphous resins known in the art can be used, but the amorphous resin preferably includes an amorphous vinyl resin. Particularly, in view of plasticity at the time of thermal fixation, a styrene-acrylic copolymer resin (styrene-acrylic resin) formed using a styrene monomer and a (meth)acrylic acid ester monomer or acrylic acid is preferable. By using the styrene-acrylic resin as the amorphous resin, it is easy to maintain negative chargeability of the toner. Further, by this, negative chargeability can be increased by emulsifying and aggregating a styrene-acrylic resin and using the resultant styrene-acrylic resin in the toner.

As the vinyl monomer forming the amorphous vinyl resin, one or two or more selected from the following monomers can be used.

(1) Styrene Monomers

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and derivatives thereof, etc.

(2) (Meth)Acrylic Acid Ester Monomers

Methyl (meth)acrylate, ethyl (meth)acrylate, n-butyl (meth)acrylate, (meth)acrylate isopropyl (meth)acrylate, isobutyl (meth)acrylate, t-butyl (meth)acrylate, n-octyl (meth)acrylate, 2-ethylhexyl (meth)acrylate, stearyl (meth) acrylate, lauryl (meth)acrylate, phenyl (meth)acrylate, diethylaminoethyl (meth)acrylate, dimethylaminoethyl (meth) acrylate, and derivatives thereof, etc.

(3) Vinyl Esters

Vinyl propionate, vinyl acetate, vinyl benzoate, etc.

(4) Vinyl Ethers

Vinyl methyl ether, vinyl ethyl ether, etc.

(5) Vinyl Ketones

Vinyl methyl ketone, vinyl ethyl ketone, vinyl hexyl ketone, etc.

(6) N-Vinyl Compounds

N-vinylcarbazole, N-vinylindole, N-vinylpyrrolidone, etc.

(7) Others

Vinyl compounds such as vinyl naphthalene and vinyl pyridine, acrylic acid or methacrylic acid derivatives such as acrylonitrile, methacrylonitrile, acrylamide, etc.

Further, as the vinyl monomer, it is preferable to use a monomer having an ionic dissociation group, for example, a carboxyl group, a sulfonic acid group, a phosphoric acid group, or the like. Specific examples thereof are as follows.

Examples of the monomer having a carboxylic group can include acrylic acid, methacrylic acid, maleic acid, itaconic acid, cinnamic acid, fumaric acid, maleic acid monoalkyl ester, itaconic acid monoalkyl ester, and the like. Further, examples of the monomer having a sulfonic acid group can include styrene sulfonic acid, allyl sulfosuccinic acid, 2-acrylamide-2-methylpropanesulfonic acid, and the like. In addition, examples of the monomer having a phosphoric acid group can include acid phosphoxyethyl methacrylate, and the like.

Moreover, it is also possible to form a vinyl resin having a crosslinked structure, by using polyfunctional vinyls as the vinyl monomer. Examples of the polyfunctional vinyls include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

Hereinabove, the vinyl resin is described in detail as a preferable example of the amorphous resin, but an amorphous polyester resin, or the like, may also be used as the amorphous resin.

[Crystalline Resin]

The crystalline resin used in the toner according to the present invention also is not particularly limited, and an existing crystalline resin known in the art can be used. The crystalline resin preferably includes a crystalline polyester resin, in view that it is easy to take a structure having high crystallinity. Here, the "crystalline polyester resin" is referred to a resin that, among known polyester resins obtained by a polycondensation reaction of divalent or more carboxylic acid (polycarboxylic acid), and divalent or more alcohol (polyhydric alcohol), has no step-wise endothermic change in measurement of differential scanning calorimetry (DSC) but has a clear endothermic peak. The clear endothermic peak specifically means a peak that has 15° C. or less half-width of the endothermic peak when measured at 10° C./min of the temperature increase rate in measurement of differential scanning calorimetry (DSC). Further, the crystalline resin includes a resin having a clear endothermic peak, rather than a step-wise endothermic change in differential scanning calorimetry (DSC) among other crystalline resins except for the crystalline polyester resin.

The polyvalent carboxylic acid is a compound having two or more carboxyl groups in one molecule. Specific examples thereof include saturated aliphatic dicarboxylic acids such as oxalic acid, malonic acid, succinic acid, adipic acid, sebacic acid (decanedioic acid), azelaic acid, n-dodecylsuccinic acid, nonanedicarboxylic acid, decanedicarboxylic acid, undecanedicarboxylic acid, dodecanedicarboxylic acid, tetradecanedicarboxylic acid; alicyclic dicarboxylic acids such as cyclohexane dicarboxylic acid; aromatic dicarboxylic acids such as phthalic acid, isophthalic acid, and terephthalic acid; trivalent or higher polyvalent carboxylic acids such as trimellitic acid and pyromellitic acid; and anhydrides, or (C1-C3) alkyl esters of these carboxylic acid. These compounds may be used singly, or may be used in combination of two or more kinds.

The polyhydric alcohol is a compound having two or more hydroxyl groups in one molecule. Specific examples thereof can include aliphatic diols such as 1,2-propanediol, 1,3-propanediol, 1,4-butanediol, 1,5-pentanediol, 1,6-hexanediol, 1,7-heptanediol, 1,8-octanediol, 1,9-nonanediol, 1,12-dodecanediol, neopentyl glycol, and 1,4-butenediol; and trivalent or more polyhydric alcohols such as glycerin, pentaerythritol, trimethylolpropane, and sorbitol. These compounds may be used singly, or may be used in combination of two or more kinds.

In the present invention, in order to allow the crystalline polyester resin to constitute the domain of the domain-matrix structure, when the carbon number of a main chain of a structural unit derived front the polyhydric alcohol for forming the crystalline polyester resin is defined as $C_{alcohol}$, and the carbon number of a main chain of a structural unit derived from the polyvalent carboxylic acid for forming the crystalline polyester resin is defined as $C_{acid}$, it is preferable that the following Correlation Equation (1) is satisfied.

$$5 \leq |C_{acid} - C_{alcohol}| \leq 12 \quad \text{Correlation Equation (1):}$$

$$C_{acid} > C_{alcohol} \quad \text{Correlation Equation (2):}$$

As the difference in the carbon number between the alcohol and the acid is increased, aggregation of the crystalline polyester resin becomes difficult, such that crystals can be finely dispersed. Therefore, when the difference is 5 or more, it is possible to prevent a large domain from being formed, and when the difference is 12 or less, it is possible to prevent a small domain from being formed.

It is preferable that a content of the crystalline polyester resin is in the range of 5 to 20% by mass relative to a total amount of resins constituting the toner. When the content of the crystalline polyester resin is 5% by mass or more, excellent low-temperature fixability can be obtained. Further, when the content of the crystalline polyester resin is 20% by mass or less, it is easy to prepare a toner.

In the present invention, a melting point of the crystalline polyester resin is a value measured by the following method (this is equally applied to other crystalline resins). That is, the melting point is measured, for example, using "Diamond DSC" (manufactured by PerkinElmer) as a differential scanning calorimeter under measurement conditions (heating-cooling conditions) in which a first heating process of raising a temperature from 0° C. to 200° C. at a heating rate of 10° C./min, a cooling process of lowering the temperature from 200° C. to 0° C. at a cooling rate of 10° C./min, and a second heating process of raising the temperature from 0° C. to 200° C. at a heating rate of 10° C./min are sequentially performed. Based on a DSC curve obtained by this measurement, a top temperature of an endothermic peak derived front the crystalline polyester resin in the first heating process is taken as a melting point (Tm). As a measurement procedure, 3.0 mg of a measurement sample (crystalline polyester resin) is sealed in an aluminum pan and set in a sample holder of the Diamond DSC. An empty aluminum pan is used as a reference.

A ratio of the crystalline resin is preferably 5 to 20% by relative to a total amount of resins constituting the toner. When the ratio of the crystalline resin is 5% by mass or more, excellent low-temperature fixability can be obtained. Further, when the ratio of the crystalline resin is 20% by mass or less, it is easy to prepare a toner.

The crystalline resin forming the domain of the domain-matrix structure preferably includes a hybrid crystalline polyester resin (hereinafter simply referred to as a "hybrid resin") formed by chemical bonding between a vinyl polymerized segment, preferably a styrene-acrylic polymerized segment, and a crystalline polyester polymerized segment. Here, the crystalline resin is a crystalline resin having the vinyl polymerized segment, preferably the styrene-acrylic polymerized segment, and the crystalline polyester polymerized segment bonded via a bireactive monomer. By hybridizing the crystalline polyester resin with the vinyl resin, preferably the styrene-acrylic resin, an interface between the domain and the matrix becomes smooth, and dispersibility of the crystalline resin can be improved.

Vinyl Polymerized Segment

The vinyl polymerized segment constituting the hybrid resin, preferably, the styrene-acrylic polymerized segment is formed from a resin obtained by polymerizing a vinyl monomer, preferably, a styrene acrylic monomer. Here, since the above-mentioned monomers constituting the vinyl resin (the vinyl monomer forming the amorphous vinyl resin) can be similarly used as the vinyl monomer, a detailed description thereof is omitted. A content of the vinyl polymerized segment in the hybrid resin is preferably in the range of 0.5 to 20% by mass.

Crystalline Polyester Polymerized Segment

The crystalline polyester polymerized segment constituting the hybrid resin is formed from a crystalline polyester resin prepared by polycondensation reaction of a polyvalent carboxylic acid and a polyhydric alcohol in the presence of a catalyst. Here, since specific kinds of the polyvalent carboxylic acid and the polyhydric alcohol are as described above, a detailed description thereof is omitted.

Bireactive Monomer

The "bireactive monomer" is referred to a monomer combining a crystalline polyester resin segment and a vinyl resin segment. Specifically, it is a monomer having both a group selected from a hydroxy group, a carboxyl group, an epoxy group, a primary amino group and a secondary amino group that forms the crystalline polyester polymerization segment, and an ethylenically unsaturated group that forms the vinyl resin segment, in the molecule. The bireactive monomer is preferably a monomer having a hydroxy group or carboxyl group, and an ethylenically unsaturated group. The bireactive monomer is further preferably a monomer having a carboxyl group, and an ethylenically unsaturated group. Specifically, the bireactive monomer is preferably a vinyl-based carboxylic acid.

Specific examples of the bireactive monomer include acrylic acid, methacrylic acid, fumaric acid, maleic acid and the like, and may also be a hydroxylalkyl (carbon atom number of 1 to 3) ester thereof. From the viewpoint of reactivity, acrylic acid, methacrylic acid or fumaric acid is preferable. The crystalline polyester resin segment and the vinyl resin segment can be combined via these bireactive monomers.

A use amount of the bireactive monomer is, from the viewpoint of improving low-temperature fixability, high-temperature offset resistance and durability of the toner, preferably 1 to 10 parts by mass and more preferably 4 to 8 parts by mass, relative to 100 parts by mass of a total amount of the vinyl monomers constituting the vinyl resin segment.

Preparation Method of Hybrid Resin

As a preparation method of the hybrid resin, an existing general scheme can be used. A representative method can include the following three methods.

(1) A method for forming a hybrid resin by previously polymerizing a crystalline polyester resin segment, reacting a bireactive monomer with the crystalline polyester resin segment, and further reacting an vinyl monomer for forming a vinyl resin segment with it.

(2) A method for forming a hybrid resin by previously polymerizing a vinyl resin segment, reacting a bireactive monomer with the vinyl resin segment, and further reacting a polycarboxylic acid and a polyhydric alcohol for forming a crystalline polyester resin segment with it.

(3) A method for forming a hybrid resin by previously polymerizing a crystalline polyester resin segment and a vinyl resin segment, reacting a bireactive monomer with these resin segments to combine them.

In the present invention, any method among the above preparation methods can be used, but a method of the above item (2) is preferred. Specifically, it is preferred to mix a polycarboxylic acid and a polyhydric alcohol for forming a crystalline polyester resin segment, and a vinyl monomer for forming a vinyl resin segment and a bireactive monomer, add a polymerization initiator thereto to form a vinyl resin segment by addition-polymerizing the vinyl monomer and the bireactive monomer, then add an esterification catalyst thereto to perform polycondensation reaction.

Here, as a catalyst for synthesizing a crystalline polyester resin segment, various conventionally known catalysts can be used. Also, the esterification catalyst includes tin compounds such as dibutyltin oxide and tin(II) 2-ethylhexanoate, titanium compounds such as titanium diisopropylate bistriethanolaminate, and the like. The esterification cocatalyst includes gallic acid and the like.

<Other Constitution Components (Internal Additives)>

The toner used in the present invention may further contain an internal additive such as a colorant, a release agent (wax), and a charge control agent, in addition to the binder resins including the crystalline resin and the amorphous resin.

<Colorant>

As the colorant contained in the toner according to the present invention, inorganic or organic colorants known in the art can be used. As the colorant, various organic and inorganic pigments and dyes as well as carbon black and magnetic powder can be used.

As a yellow colorant for a yellow toner, dyes such as C.I. Solvent Yellow 19, 44, 77, 79, 81, 82, 93, 98, 103, 104, 112, and 162 and pigments such as C.I. Pigment Yellow 14, 17, 74, 93, 94, 138, 155, 180, and 185 can be used, and a mixture thereof can also be used.

As a magenta colorant for a magenta toner, dyes such as C.I. Solvent Red 1, 49, 52, 58, 63, 111, and 122 and pigments such as C.I. Pigment Red 5, 48:1, 53:1, 57:1, 122, 139, 144, 149, 166, 177, 178, and 222 can be used, and a mixture thereof can also be used.

As a cyan colorant for a cyan toner, dyes such as C.I. Solvent Blue 25, 36, 60, 70, 93, and 95 and pigments such as C.I. Pigment Blue 1, 7, 15:3, 18:3, 60, 62, 66, and 76 can be used, and a mixture thereof can also be used.

As a green colorant for a green toner, dyes such as C.I. Solvent Green 3, 5, and 28 and pigments such as C.I. Pigment Green 7 can be used, and a mixture thereof can also be used.

As an orange colorant for an orange toner, dyes such as C.I. Solvent Orange 63, 68, 71, 72, and 78 and pigments such as C.I. Pigment Orange 16, 36, 43, 51, 55, 59, 61, and 71 can be used, and a mixture thereof can also be used.

As a black colorant for a black toner, carbon black, a magnetic material, an iron titanium composite oxide black, and the like, can be used, and a mixture thereof can also be used. As carbon black, channel black, furnace black, acetylene black, thermal black, lamp black, and the like, can be used. Further, as an example of the magnetic material, ferrite, magnetite, and the like, can be used.

A content of the colorant is preferably 0.5 to 20% by mass, and more preferably 2 to 10% by mass, relative to a total mass of the toner. When the content of the colorant is within the above-mentioned range, color reproducibility of an image can be secured.

Further, a size of the colorant is preferably 10 to 1,000 nm, more preferably 50 to 500 nm, and particularly preferably 80 to 300 nm, in terms of volume average particle diameter (volume-based median diameter). The volume average particle diameter may be a value indicated in a catalog. For example, the volume average particle diameter (volume-based median diameter) of the colorant can be measured using a particle diameter distribution measurement device, for example, "UPA-150" (manufactured by NIKKISO Co., Ltd.).

<Release Agent>

The toner according to the present invention may contain a release agent. Examples of the release agent can include polyethylene wax, paraffin wax, microcrystalline wax, Fischer-Tropsch wax, dialkyl ketone-based waxes such as distearyl ketone, carnauba wax, montan wax, ester-based waxes such as behenyl behenate, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecane diol distearate, tristearyl trimellitate, and distearyl maleate, amide-based waxes such as ethylene diamine dibehenylamide and tristearylamide trimellitate, and the like. These release agents can be used singly or in combination of two or more kinds.

A content of the release agent in the toner is preferably in the range of 2 to 30% by mass, more preferably, 5 to 20% by mass, relative to a total mass of the toner.

<Charge Control Agent>

The toner according to the present invention can optionally contain a charge control agent (internally). As the charge control agent, various charge control agents known in the art can be used.

As the charge control agent, various compounds known in the art, which can be dispersed in an aqueous medium, can be used. Specific examples thereof can include nigrosine based dyes, metal salts of naphthenic acid or higher fatty acids, alkoxylated amines, quaternary ammonium salt compounds, azo based metal complexes, salicylic acid metal salts or metal complexes thereof, and the like.

A content of the charge control agent is preferably 0.1 to 10% by mass, more preferably 0.5 to 5% by mass, relative to a total amount of the binder resin.

[Form of Toner]

A form of the toner according to the present invention is not particularly limited. For example, the toner may have a so-called single layer structure (a homogeneous structure that is not a core-shell structure), a core-shell structure, or a multilayer structure composed of three or more layers.

[Volume-Based Median Diameter of Toner Base Particle]

A particle diameter of the toner base particle constituting the toner according to the present invention is preferably 2 to 8 μm, and more preferably 3 to 6 μm, in terms of a volume-based median diameter. When the volume-based median diameter of the toner base particle is 2 μm or more, sufficient fluidity can be maintained. When the volume-based median diameter of the toner base particle is 8 μm or less, high image quality can be maintained. Further, when the volume-based median diameter of the toner base particle is within the above-mentioned range, transfer efficiency can be enhanced, halftone image quality can be improved, and image quality such as of fine lines and dots can be improved.

<Measurement Method of Volume-Based Median Diameter of Toner Base Particle>

The volume-based median diameter of the toner base particle is measured and calculated, for example, using a measurement device in which a computer system equipped with a software for data processing "Software V3.51" is connected to "Coulter Multisizer 3" (manufactured by Beckman Coulter, Inc.). Specifically, 0.02 g of a measurement sample (toner) is added to and wetted with 20 mL of a surfactant solution prepared by, for example, diluting a neutral detergent containing a surfactant component 10 times with pure water for the purpose of dispersing toner particles), and then subjected to ultrasonic dispersion for 1 minute, thereby preparing a toner dispersion. The toner dispersion is injected by a pipette into a beaker containing "ISOTONII" (manufactured by Beckman Coulter, Inc.) in a sample stand until a display concentration of the measurement device reaches 8%. A reproducible measurement value can be obtained within this concentration range. Further, in the measurement device, the count of particles is set to 25,000, an aperture diameter is set to 100 μm, a measurement range of 2 to 60 μm is divided into 256 sections, and a frequency value in each section is computed. Then, a particle diameter when a cumulative volume fraction cumulated from the large-diameter side reaches 50% is defined as the volume-based median diameter.

Further, the volume-based median diameter of the toner base particle can also be measured by separating an external additive from a toner sample to which the external additive has been treated (externally added) and using it as a sample. In this case, the external additive is separated by the following method.

More specifically, 4 g of a toner is wetted with 40 g of a 0.2% by mass aqueous solution of polyoxyethyl phenyl ether, and ultrasonic energy is adjusted using an ultrasonic homogenizer (for example, US-1200T, manufactured by Nippon Seiki Co., Ltd., specification frequency: 15 kHz) so that a value of an ammeter showing a vibration instruction value attached to a main device, indicates 60 ρA (50 W) and is applied thereto for 30 minutes. Thereafter, the external additive is washed off with a membrane filter having a pore diameter of 1 μm, and the toner component on the filter becomes a measurement target.

<<External Additive of Toner>>

In view of controlling fluidity, chargeability, or the like, of the toner, the toner preferably further contains an external additive. The external additive is (externally) added to a surface of a toner base particle, and includes external additive particles such as inorganic particles and organic particles known in the art, a lubricant, and the like. As these external additives, various external additives may be used in combination.

According to the present invention, the toner contains inorganic particles as the external additive particles. The toner contains the inorganic particles as the external additive particles, such that as compared to inorganic particles used in a toner such as titanium oxide or alumina, silica used in pre-treatment of the carrier in the present invention has high volume resistance and excellent charge retention ability. Further, since silica particles have good dispersibility as compared to other inorganic particles, the silica particles can be more uniformly dispersed on the surface of the carrier, and chargeability of the carrier can be uniformly distributed.

Examples of the inorganic particles essentially used as the external additive particles as described above can include silica particles, titania particles, alumina particles, zirconia particles, zinc oxide particles, chromium oxide particles, cerium oxide particles, antimony oxide particles, tungsten oxide particles, tin oxide particles, tellurium oxide particles, manganese oxide particles, boron oxide particles, and the like.

A number average primary particle diameter of the external additive particles can be adjusted by, for example, classification or mixing of classified products.

The external additive particles (particularly, the inorganic particles, among them, silica particles) are preferably subjected to surface-treatment (hydrophobic treatment) with a surface-treating agent (hydrophobic agent). By the surface-treatment of the inorganic particles, among them, the silica particles, it becomes difficult to adsorb moisture and thus, a decrease in charge amount can be more effectively suppressed. A surface-treating agent known in the art can be used in the surface-treatment. Examples of the surface-treating agent include a silane coupling agent, a titanate based coupling agent, an aluminate based coupling agent, fatty acid, fatty acid metal salts and esterified products thereof, rosin acids, silicone oil, and the like.

According to the present invention, the inorganic particles comprise preferably at least silica particles having the same number average particle diameter (10 to 30 nm) as those of silica particles attached to a surface of a carrier to be described later, and are attached in an amount in the range of the following Equation (2). That is, in view of maintaining chargeability of the toner side, it is preferable that the inorganic particles corresponding to the external additive particles of the toner are silica particles having the same size as those in the carrier side.

$$10 \text{ at } \% \leq S2 \leq 14 \text{ at } \% \quad (2)$$

In Equation, S2 represents a concentration of Si element as measured by XPS and indicates an amount of silicon (Si) on the surface of the toner.

In the term "the inorganic particle" as used herein, since the term "the" is used, the inorganic particle is an "inorganic particle" included in the external additive particle of a toner. In the term "the silica particle" as used herein, since the term "the" is also used, the silica particle indicates "a silica particle having a number average particle diameter of 10 to 30 nm" used in the surface of a carrier. Therefore, the phase "the inorganic particle comprises the silica particle" means that the "inorganic particle" included in the external additive particle of the toner comprises "the silica particle having a number average particle diameter of 10 to 30 nm" used in the surface of the carrier. Therefore, "the silica particle having a number average particle diameter of 10 to 30 nm" used in the carrier is the same as at least one of "silica particle" (preferably, a surface-treated hydrophobic silica particle) of the inorganic particle included in the external additive particle of the toner (for example, hydrophobic silica particles (number average particle diameter: 12 nm) as described in Example 1 are equally used in both the carrier and the external additive particle). Further, the inorganic particle may comprise silica particles having a different number average particle diameter or titania particles as described in Example 1, as well as "the silica particle".

A number average particle diameter of the silica particles attached to the surface of the toner or an amount of silicon (Si) on the surface of the carrier can be obtained by a method descried in "Measurement of Amount (at %) of Silica Particles (External Additive Particles) on Surface of Toner by XPS" or "Measurement of Particle Diameter of Silica Particles (External Additive Particles) on Surface of Toner" to be described below, after separating and recovering a toner from a developer according to the following separation method of the toner.

[Separation Method of Toner from Developer]

Figure 2:
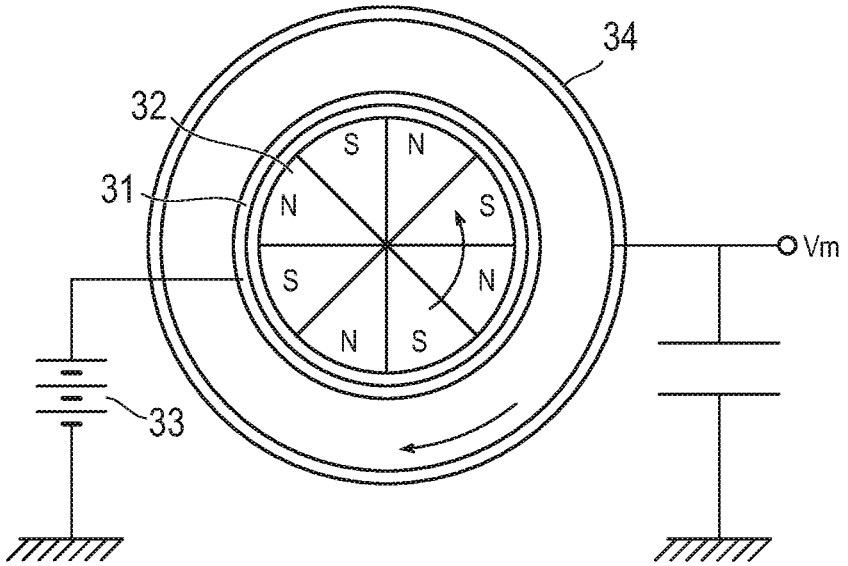
FIG. 2 is a schematic view of an apparatus for separating and recovering a carrier in a developer, wherein reference numeral 31 denotes a conductive sleeve, reference numeral 32 denotes a magnet roll, reference numeral 33 denotes a bias power supply, and reference numeral 34 denotes a cylindrical electrode.

Separation and recovery of the toner in the developer according to the present invention is performed using an apparatus illustrated in FIG. 2. First, 1 g of a developer weighed with a precision balance is placed on an entire surface of a conductive sleeve 31 so as to be uniform. A voltage of 3 kV is supplied from a bias power supply 33 to the sleeve 31, and at the same time, the number of revolutions of a magnet roll 32 installed in the conductive sleeve 31 is set to 2000 rpm. In this state, the toner is allowed to stand for 60 seconds, to collect and recover a toner on the cylindrical electrode 34, such that the toner can be separated and obtained from the developer. In addition, after 60 seconds, a carrier remaining on the sleeve 31 is recovered, such that the carrier can be separated and obtained from the developer.

[Amount (at %) of Silica Particles (External Additive Particles) on Surface of Toner by XPS]

In view of maintaining chargeability on the toner side, an amount S2 (amount (at %) of silicon) of silica particles (external additive particles) on a surface of a toner obtained by the separation method of toner from developer described above is 10 to 14 at % and preferably 11 to 13 at %. When the amount S2 of the silica particles existing on the surface of the toner (that is, the amount (at %) of silicon on the surface of the toner) is 10 at % or more, a charge amount can be effectively maintained by preventing surface resistance of the toner from being excessively decreased. This is also preferable in view of heat-resistant storage property of toner. Meanwhile, when the amount S2 of the silica particles existing on the surface of the toner (that is, the amount (at %) of silicon on the surface of the toner) is 14 at % or less, it is possible to prevent resistance of toner from being excessively increased, charge retention ability is excellent, and it is possible to effectively prevent developability from being deteriorated.

[Measurement of Amount S2 (at %) of Silica Particles on Surface of Toner by XPS]

XPS analyzer K-α (manufactured by Thermo Fisher Scientific K.K.) is used as a measurement device. For measurement conditions, elements C, Si, Ti, Al, O, Zn, Fe, Mn and Mg are selected for measurement, and surface element analysis is performed under the following conditions. As a result, a concentration of Si element (amount of silica on the surface of the toner of the developer) measured by XPS can be obtained.

Spot diameter: 400 μm

Number of Scans: 15 times

PASS Energy: 50 eV

Analysis method: Smart method.

[Particle Diameter of Silica Particle (External Additive Particle) on Surface of Toner]

A number average particle diameter of silica particles attached to a surface of a toner is preferably 10 to 30 nm which is the same as that of the silica particles attached to a surface of a carrier. The reason is that by using silica particles having the same particle diameter as those in the carrier side, change in charge amount can be suppressed, even if the silica particles migrate between the carrier and the toner during the use period (while the image forming apparatus is in operation). When the number average particle diameter of the silica particles is 30 nm or less, it is possible to prevent the silica particles attached to the surface of the toner from migrating to the carrier side. Further, when the number average particle diameter of the silica particles is 10 nm or more, it is possible to prevent disintegration of the silica particles themselves during the external addition treatment and thus to prevent an aggregate of the silica particles from being formed. It is also possible to prevent the silica particles desired to be attached to the surface of the toner front migrating to the carrier side. In this regard, it is more preferable that the number average particle diameter of silica particles attached to the surface of the toner is in the range of 10 to 20 nm. In this case, it is more preferable to adjust the number average particle diameter of the silica particles to be attached to the surface of the toner to be in the range of 10 to 20 nm so as to be equal to the silica particles to be attached to the surface of the carrier.

The number average particle diameter of silica particles (external additive particles) as described above can be adjusted by, for example, classification or mixing of classified products.

[Measurement of Particle Diameter of Silica Particle (External Additive) on Surface of Toner]

The number average particle diameter of silica particles attached to a toner is measured as follows. A scanning electron microscope (SEM) photograph magnified 50,000 times using a scanning electron microscope (SEM), for example, "JEM-7401F" (manufactured by JEOL Ltd.) was scanned by a scanner, and silica particles on a surface of a toner in the SEM photographic image was binarized using an image processing analyzer "LUZEX AP" (manufactured by Nireco Corporation). Feret's diameters of 100 silica particles on the surface of the toner in a horizontal direction are calculated, and an average value thereof is determined as the number average particle diameter.

As the silica particles to be attached to the surface of the toner, silica particles known in the art can be used, but as a preparation method of the silica particles to be attached to the surface of the toner according to the present invention, a vapor phase method is preferable.

Since silica particles prepared by the vapor phase method have a low sphericity, they can be contacted at a plurality of points, not one point, at the time of externally adding the silica particles to attach the silica particles to the toner. Therefore, it is difficult to detach the silica particles from the toner, and thus, it is possible to suppress the silica particles from migrating to the carrier side, which is preferable.

A preparation method using the vapor phase method is a method of preparing silica particles by introducing a raw material of silica particles into a high temperature flame in a vapor state or a powder state and oxidizing them. Examples of the raw material of the silica particles can include halogenated silicon such as silicon tetrachloride, organosilicon compounds, or the like.

Further, a specific method for preparing silica particles by the vapor phase method using vapor, and the like, is similar to that of silica particles attached to a surface of a carrier to be described later. Therefore, a description thereof is omitted.

Further, a detailed description of hydrophobic treatment of silica particles is also similar to that of silica particles attached to a surface of a carrier to be described later. Therefore, a description thereof is omitted.

[Other External Additive]

The toner according to the present invention may also further contain another external additive known in the art as an external additive in addition to the above-mentioned silica particles. Examples of the external additives can include inorganic particles, for example, inorganic oxide particles such as aluminum oxide particles and titanium oxide particles, inorganic stearic acid compound particles such as aluminum stearate particles and zinc stearate particles, and inorganic titanic acid compound particles made of strontium titanate, zinc titanate, and the like. These inorganic particles may be subjected to gloss treatment, hydrophobic treatment, or the like, with a silane coupling agent, a titanium coupling agent, a higher fatty acid, a silicone oil, or the like, in order to improve a heat-resistant storage property, environmental stability, and the like.

A particle diameter of the external additive is not particularly limited, but a number average particle diameter is preferably 10 to 150 nm.

Further, the toner can further contain the inorganic particles (except the above-mentioned silica particles) surface-treated with a surface-treating agent as another external additive. Examples of the surface-treating agent can include hexamethyldisilazane (HMDS), diphenyldimethoxysilane, diphenyldiethoxysilane, dibenzyldimethoxysilane, dibenzyldiethoxysilane, phenyltrimethoxysilane, cyclohexylmethyldimethoxysilane, cyclohexyltrimethoxysilane, cyclopentyltrimethoxysilane, phenethyltrimethoxysilane, phenethylmethyldimethoxysilane, phenethyldimethylmethoxysilane, phenethyltriethoxysilane, polydimethylsiloxane (PDMS), 3-aminopropyltrimethoxysilane, and the like. The surface-treating agent may be used singly or in combination of two or more kinds.

Among them, in view of improving fluidity of the external additive, inorganic particles (for example, titanium oxide particles, or the like) surface-treated (hydrophobilized) with hexamethyldisilazane are preferably used as another external additive. A particle diameter of the surface-treated inorganic particles is not particularly limited, but a number average particle diameter thereof is preferably 10 to 30 nm. As used herein, the number average particle diameter can be measured in the same manner as described in measurement of the particle diameter of the silica particles (external additive) on the surface of the toner or measurement of the particle diameter of the silica particles on the surface of the carrier. In addition, an addition amount of another external additive (the surface-treated inorganic particles) is preferably 0.1 to 1.0 part by mass relative to 100 parts by mass of the toner base particle.

Further, as another external additive, organic particles can also be used. Spherical organic particles having a number average particle diameter of about 10 to 2000 nm can be used as the organic particles. Specifically, organic particles made of a homopolymer of styrene, methylmethacrylate, or the like, or a copolymer thereof can be used.

As the external additive, a lubricant can also be used. The lubricant is used in order to further improve a cleaning property or transferring property. Specific examples thereof can include higher fatty acid metal salts such as stearate of zinc, aluminum, copper, magnesium, calcium, or the like, oleate of zinc, manganese, iron, copper, magnesium, or the like, palmitate of zinc, copper, magnesium, calcium, or the like, linoleate of zinc, calcium, or the like, and ricinoleate of zinc, calcium, or the like.

The another external additive may be used singly or in combination of two or more kinds.

Further, an amount of the external additive in the toner is not particularly limited, but is preferably 0.1 to 10.0% by mass, more preferably 1.0 to 3.0% by mass, relative to 100% by mass of a total mass of the toner.

As a method of adding (externally adding) the external additive, there can be mentioned a method of adding the external additive using various mixing apparatuses known in the art such as a turbula mixer, a Henschel mixer, a Nauta mixer, a V-shaped mixer, and the like.

<<Preparation Method of Toner>>

A preparation method of the toner according to the present invention is not particularly limited, but methods known in the art such as a kneading-pulverization method, a suspension polymerization method, an emulsion aggregation method, an emulsion polymerization aggregation method (emulsion polymerization association method), a dissolution suspension method, a polyester elongation method, and a dispersion polymerization method can be used. Among them, a build-up type preparation method such as the emulsion polymerization association method, the suspension polymerization method, or the like, rather than the pulverization method, is preferable in view of a decrease in particle diameter of the toner and controllability of circularity. Among them, the emulsion polymerization aggregation method and the emulsion aggregation method can be more preferably used.

The emulsion polymerization aggregation method, a preferable example of the preparation method of the toner according to the present invention is as follows. That is, a dispersion of particles of a binder resin (hereinafter, referred to as "binder resin particles") prepared by an emulsion polymerization method is prepared. Then, toner particles are produced by mixing the dispersion of the binder resin particles with a dispersion of particles of a colorant (hereinafter, referred to as "colorant particles") and a dispersion of a release agent such as wax, aggregating the mixture until toner particles have a particle diameter to be desired, and performing fusion of the binder resin particles to control a shape.

Further, the emulsion aggregation method, another preferable example of the preparation method of the toner according to the present invention is as follows. That is, a binder resin solution dissolved in a solvent is dropped into a poor solvent to obtain a dispersion of resin particles. Then, toner particles are produced by mixing the dispersion of resin particles with a dispersion of a colorant and a dispersion of a release agent such as wax, aggregating the mixture until toner particles have a particle diameter to be desired, and performing fusion of the binder resin particles to control a shape.

Any preparation method can be applied to the toner according to the present invention.

As an example, a case where the emulsion polymerization aggregation method is used as the preparation method of the toner according to the present invention is described below:

(1) a process of preparing a dispersion in which colorant particles are dispersed in an aqueous medium;

(2) a process of preparing a dispersion in which binder resin particles optionally containing an internal additive (a release agent, a charge control agent, and the like) are dispersed in an aqueous medium;

(3) a process of preparing a dispersion of binder resin particles by emulsion polymerization;

(4) a process of mixing the dispersion of colorant particles and the dispersion of binder resin particles and aggregating, associating, and fusing the colorant particles and the binder resin particles to form toner base particles;

(5) a process of filtering and separating the toner base particles from the dispersion (aqueous medium) of the toner base particles and removing a surfactant, or the like;

(6) a process of drying the toner base particles; and (7) a process of adding an external additive to the toner base particles.

In the case of preparing a toner using the emulsion polymerization aggregation method, binder resin particles obtained by the emulsion polymerization method may have a multilayer structure of two or more layers made of binder resins having different compositions. In order to prepare the binder resin particles having such a structure, for example, binder resin particles having a two-layer structure, a dispersion of resin particles is prepared by emulsion polymerization treatment (first-stage polymerization) according to an ordinary method. A polymerization initiator and a polymerizable monomer are added to the dispersion, and subjected to polymerization treatment (second-stage polymerization), such that the binder resin particles having a two-layer structure can be obtained.

Further, toner particles having a core-shell structure can also be obtained by the emulsion polymerization aggregation method. Specifically, in order to prepare the toner particles having the core-shell structure, first, core particles are prepared by aggregating, associating and fusing binder resin particles for core particles with colorant particles. Next, binder resin particles for a shell layer are added to a dispersion of the core particles to aggregate and fuse the binder resin particles for a shell layer on the surface of the core particles to form a shell layer covering the surface of the core particles, thereby obtaining the toner particles having the core-shell structure.

As an example, a case where a pulverization method is used as a method for preparing the toner of the present invention will be described below:

(1) a process of mixing a binder resin, a colorant, and, if necessary, an internal additive with each other using a Henschel mixer, or the like;

(2) a process of kneading the obtained mixture while heating by an extrusion kneader, or the like;

(3) a process of subjecting the obtained kneaded product to coarse pulverization treatment with a hammer mill, or the like, and then subjecting the coarse pulverized product to pulverization treatment with a turbo mill, or the like;

(4) a process of finely classifying the obtained pulverized product using an airflow classifier utilizing Coanda effect to form toner base particles; and (5) a process of adding an external additive to the toner base particles.

[Particle Diameter of Toner Particle]

A particle diameter of a toner particle constituting the toner according to the present invention is, for example, preferably 3 to 8 μm, and more preferably 3 to 6 μm, in terms of a volume-based median diameter. When the particle diameter of the toner particle is 3 μm or more, sufficient fluidity can be maintained. Further, when the particle diameter of the toner particle is 8 μm or less, high image quality can be maintained.

When the volume-based median diameter is within the above-mentioned range, transfer efficiency can be increased, such that halftone image quality can be improved, and image quality such as of fine lines and dots can be improved.

The volume-based median diameter of the toner particle is measured and calculated, for example, using a measurement device in which a data processing computer system (manufactured by Beckman Coulter, Inc.) is connected to "Multisizer 3" (manufactured by Beckman Coulter, Inc.).

More specifically, after 0.02 g of a toner is added to and wetted with 20 mL of a surfactant solution (for example, a surfactant solution obtained by diluting a neutral detergent containing a surfactant component with pure water by 10 times, in order to disperse toner particles), ultrasonic dispersion treatment was performed thereon for 1 minute to prepare a dispersion of toner particles, and the dispersion of toner particles is injected into a beaker containing "ISOTONII" (manufactured by Beckman Coulter, Inc.) in a sample stand using a pipette until a display concentration of the measurement device reaches 5-10%. Here, a reproducible measurement value can be obtained within this concentration range. Further, in the measurement device, the number of particles to be counted is set to 25,000, an aperture diameter is set to 50 μm, a measurement range of 1 to 30 μm is divided into 256 sections, and a frequency value in each section is computed. Then, a particle diameter when a cumulative volume fraction cumulated from a large-diameter side reaches 50% is defined as the volume-based median diameter.

<Carrier>

The carrier is made of a magnetic material. Examples of the carrier include a coated carrier having a core material (also referred to as a carrier core material, a carrier core, a magnetic particle) made of a magnetic material and a layer (a coating layer) of a coating material (a coating resin) coating a surface of the core material, and a resin-dispersion carrier in which fine particles of magnetic material are dispersed in a resin. In view of suppressing the carrier from being attached to a photosensitive material, it is preferable that the carrier is the coated carrier.

<Core Material>

Composition (Constituent Material) of Core Material

Examples of the core material used in the present invention can include iron powder, magnetite, various ferrite based particles, or dispersions in which such a material is dispersed in a resin. Preferably, the core material is magnetite or various ferrite based particles. As the ferrite, ferrite containing a heavy metal such as copper, zinc, nickel, or manganese, or light metal ferrite containing an alkali metal and/or a Group 2 metal is preferable.

Further, the core material preferably contains Sr. The core material contains Sr, such that surface roughness of the core material can be increased, and even though the core material is coated with a resin, it is easy to expose a surface of the core material, and thus, it is easy to adjust resistance of the carrier.

Shape Factor of Core Material

A shape factor (SF-1) of the core material is preferably 110 to 150. The shape factor can be adjusted by an amount of Sr, but can also be adjusted by changing a sintering temperature in a preparation method to be described below.

Hereinafter, a measurement method of the shape factor (SF-1) of the core material will be described.

The shape factor (SF-1) of the core material is a numerical value calculated by the following Equation 1.

$$\text{SF-1}=(\text{maximum length of core material})^2/(\text{projected area of core material})\times(\pi/4)\times 100 \quad \text{Equation 1:}$$

First, the measurement method of the SF-1 of the core material will be described. In measuring the SF-1 of the core material, a carrier is prepared, but in the case where it is not a single carrier but a developer, preliminary preparation is carried out.

A developer, a small amount of neutral detergent, and pure water are added and well-mixed with each other in a beaker, and a supernatant is discarded while a magnet is placed on a bottom of the beaker. Only the carrier is separated by adding pure water thereto to discard a supernatant to remove a toner and the neutral detergent. The carrier is dried at 40° C., such that a single carrier may be obtained.

Continuously, a coating layer (coating resin layer, resin coating layer, or coating layer) is dissolved in a solvent and removed.

In detail, after 2 g of the carrier is placed in a 20 ml of a glass bottle, 15 ml of methyl ethyl ketone is put into the glass bottle and stirred with a wave rotor for 10 minutes, to dissolve the coating layer with the solvent. The solvent is removed using a magnet, and a core material is washed three times with 10 ml of methyl ethyl ketone. The washed core material is dried, thereby obtaining the core material. Further, in the present invention, since silica particles present on the surface of a carrier are attached to the coating layer, if the silica particles cannot be removed by the operation with the neutral detergent, the silica particles are also left together with the core material by dissolving the coating layer in the solvent. In this case, only the core material may be separated by adding a small amount of neutral detergent and pure water thereto again to be well wetted therewith, discarding a supernatant while placing a magnet on the bottom of the beaker, and then adding pure water thereto and discarding a supernatant, followed by drying, such that the core material may be obtained. In the present invention, the core material means particles after performing the above-mentioned pretreatment.

Photographs of 100 or more core material particles were randomly taken at magnification of 150× with a scanning electron microscope, and photographic images obtaining by scanning these photographs by a scanner were measured using an image processing analyzer LUZEX AP (manufactured by Nireco Corporation). A number average particle diameter is calculated as an average value of Feret's diameters in a horizontal direction, and a shape factor is a value calculated from an average value of the shape factors SF-1 calculated by Equation 1.

Particle Diameter and Magnetization of Core Material

A particle diameter of the core material is preferably 10 to 100 μm, more preferably 20 to 80 μm, in terms of a volume average particle diameter. Further, as a magnetic property of the magnetic material itself, saturation magnetization is preferably $2.5\times10^{-5}$ to $15.0\times10^{-5}$ Wb·m/kgG.

Hereinafter, measurement methods of the particle diameter and saturation magnetization of the core material will be described.

The volume average particle diameter of the core material is a volume-based average particle diameter measured by a laser diffraction type particle diameter distribution measurement device "HELOS" (manufactured by SYMPATEC) equipped with a wet disperser. The saturation magnetization is measured by "DC magnetization characteristic automatic recording device 3257-35" (manufactured by Yokogawa Electric Corp.).

Preparation Method of Core Material

After weighing a suitable amount of a raw material, the raw material is pulverized and mixed for preferably 0.5 hour or more, more preferably 1 to 20 hours, using a wet media mill, a ball mill, a vibration mill, or the like. The pulverized product obtained as described above is pelletized using a pressure molding machine, or the like, and then preliminarily sintered at a temperature of preferably 700 to 1,200° C. for preferably 0.5 to 5 hours.

After pulverizing the raw material without using a pressure molding machine and adding water to make a slurry, the slurry may be granulated by using a spray dryer. After preliminary sintering, the resultant is pulverized again with a ball mill, a vibration mill, or the like, and then water, if necessary, a dispersant, a binder such as polyvinyl alcohol (PVA), or the like, are added thereto to adjust a viscosity. Then, the resultant is granulated and main sintering is performed thereon. A main sintering temperature is preferably 1000 to 1500° C., and a main sintering time is preferably 1 to 24 hours. At the time of pulverization after the preliminary sintering, water may be added thereto, such that pulverization may be performed using a wet ball mill, a wet vibration mill, or the like.

A pulverizer such as the above-mentioned ball mill and vibration mill is not particularly limited, but in order to effectively and uniformly disperse the raw materials, it is preferable to use fine beads having a particle diameter of 1 cm or less in a medium to be used. Further, a degree of pulverization can be controlled by adjusting a diameter of the bead to be used, a composition, and a pulverization time.

The sintered product obtained as described above is pulverized and classified. As a classification method, an existing wind classification method, mesh filtration method, precipitation method, or the like, can be used to adjust a particle diameter of the resultant to a desired particle diameter.

Thereafter, if necessary, a surface of the resultant is heated at a low temperature to perform oxide film-forming treatment, thereby adjusting resistance. In the oxide film-forming treatment, thermal treatment can be performed, for example, at 300 to 700° C., using a general rotary type electric furnace, a batch type electric furnace, or the like. An oxide film formed by this treatment has a thickness preferably of 0.1 nm to 5 μm. The thickness of the oxide film within the above-mentioned range is preferable in that an effect of the oxide film can be obtained, resistance is not excessively increased, and it is easy to obtain desired characteristics. If necessary, reduction may be performed before oxide film-forming treatment. Further, after classification, a low magnetic product may be further separated again by magnetic separation.

<Coating Layer>

Coating Resin (Resin for Coating)

Examples of a coating resin suitable for forming the coating layer of the carrier according to the present invention include polyolefin resins such as polyethylene, polypropylene, chlorinated polyethylene, and chlorosulfonated polyethylene; polystyrene, polyacrylate, for example, polymethyl methacrylate, or the like, polyacrylonitrile, polyvinyl and polyvinylidene resins such as polyvinyl acetate, polyvinyl alcohol, polyvinyl butyral, polyvinyl chloride, polyvinyl carbazole, polyvinyl ether, polyvinyl ketone, and the like; copolymers such as a vinyl chloride-vinyl acetate copolymer or a styrene-acrylic acid copolymer; a silicone resin composed of an organosiloxane bond or a modified resin thereof (for example, modified resins with an alkyd resin, polyester resin, epoxy resin, or polyurethane, etc.); polytetrachloroethylene; fluoride resins such as polyvinyl fluoride, polyvinylidene fluoride, polychlorotrifluoroethylene; polyamides; polyesters; polyurethanes; polycarbonates; amino resins such as a urea-formaldehyde resin; epoxy resins, and the like. Further, the polyacrylate resin is preferable. Among them, a resin obtained by polymerizing a monomer containing an alicyclic (meth)acrylic acid ester compound is preferable. When such a structural unit is contained, hydrophobicity of a coating resin (a coating layer) can be increased, and particularly, a moisture adsorption amount of carrier particles can be decreased under high temperature and high humidity conditions. For this reason, a decrease in charge amount of the carrier under high temperature and high humidity conditions can be suppressed. Further, since the structural unit has a rigid cyclic backbone, film strength of the coating resin (coating layer) can be improved, and durability of the carrier can be improved. Further, a copolymer of an alicyclic (meth)acrylic acid ester compound and methyl methacrylate is more preferable. The reason is that the film strength can be further increased by using methyl methacrylate.

In view of mechanical strength, environmental stability of charge amount (an environmental difference in charge amount is small), easy polymerization, and easy availability, the alicyclic (meth)acrylic acid ester compound has preferably a cycloalkyl group of 5 to 8 carbon atoms. The alicyclic (meth)acrylic acid ester compound is preferably at least one selected from the group consisting of cyclopentyl (meth) acrylate, cyclohexyl (meth)acrylate, cycloheptyl (meth) acrylate, and cyclooctyl (meth)acrylate. In view of mechanical strength and environmental stability of charge amount, the alicyclic (meth)acrylic acid ester compound preferably contains cyclohexyl (meth)acrylate.

A content of a structural unit derived from the alicyclic (meth)acrylic acid ester compound in a coating resin used to form a coating layer is preferably 10 to 100% by mass, and more preferably 20 to 100% by mass. Within the above-mentioned range, environmental stability of charge amount and durability of the carrier can be further improved.

An amount of the coating resin to be added is preferably 1 part by mass or more to 5 parts by mass or less, and more preferably 1.5 parts by mass or more to 4 parts by mass or less, relative to 100 parts by mass of core particle. When the amount of the coating resin is 1 part by mass or more, a charge amount can be effectively maintained. Further, when the amount of the coating resin is 5 parts by mass or less, it is possible to prevent resistance from being excessively increased.

Coating Method

As a specific preparation method of the coating layer of the carrier according to the present invention, there are a wet coating method and a dry coating method. Hereinafter, each of the methods will be described, but since the dry coating method is particularly preferably applied to the present invention, particularly, the dry coating method will be described in detail.

Examples of the wet coating method are as follows:

(1) Fluidized Bed Spray Coating Method

A method in which a coating solution prepared by dissolving a coating resin in a solvent is sprayed onto a surface of a core material using a fluidized bed and then dried to prepare a coating layer;

(2) Immersion Coating Method

A method in which a core material is immersed in a coating solution prepared by dissolving a coating resin in a solvent to thereby be coated, and then dried to prepare a coating layer; and (3) Polymerization Method A method in which a core material is immersed in a coating solution prepared by dissolving a reactive compound in a solvent to thereby be coated, and then heated to carry out polymerization reaction to prepare a coating layer.

Dry Coating Method

The dry coating method is a method of preparing a coating layer by coating and attaching coating resin particles (resin particles for coating) on a surface of a core material to be coated, and then applying mechanical impact force thereto to melt or soften the coating resin particles coated on and attached to the surface of the core material to be coated to thereby be fixedly attached thereto. A core material, a coating resin, low-resistance particles, and the like, are stirred with each other at a high speed using a high-speed stirring mixer capable of imparting a mechanical impact force under non-heating or heating conditions, impact force is repeatedly applied to the mixture to dissolve or soften the mixture on the surface of the core material, thereby preparing a carrier fixed thereto. As coating conditions, in the case of heating, a temperature is preferably 80 to 130° C. Further, a wind speed at which the impact force is generated is preferably 10 m/s or more during the heating, while at the time of cooling, the wind speed is preferably 5 m/s or less in order to suppress aggregation of carrier particles. A time for imparting impact force is preferably 20 to 60 minutes.

In the above-mentioned coating process of the coating resin or a process after the coating, a method of peeling a coating resin on a convex portion of a core material and exposing the core material by applying stress to a carrier will be described. In a coating process using the dry coating method, a resin can be peeled off by adjusting a wind speed at the time of cooling to a high-speed shearing speed while lowering a heating temperature to 60° C. or less. In addition, as the process after the coating, any device capable of forced stirring can be used, for example, stirring and mixing with a turbula mixer, a ball mill, a vibration mill, or the like, can be mentioned.

Next, as a method of exposing a core material by applying heat and impact to a coating resin to move the coating resin on the surface of a convex portion of a core material toward a concave portion, it is effective that a time to apply impact force is long. Specifically, the time is set to preferably 1 hour and a half or more.

<Characteristics of Carrier>

Resistance of Carrier

Resistance of the carrier is preferably $1.0\times10^{9}$ to $1.0\times10^{11}$ Ω·cm, and more preferably $1.0\times10^{9}$ to $5.0\times10^{10}$ Ω·cm. When resistance of the carrier is $1.0\times10^{9}$ Ω·cm or more, it is possible to prevent charges to be charged as a developer from being easily leaked. Further, when resistance of the carrier is $1.0\times10^{11}$ Ω·cm or less, it is possible to prevent a charge rising property from becoming worse at the time of stirring in a developing device.

In the present invention, resistance of the carrier means initial resistance of the carrier and resistance of the carrier obtained by separating a toner from a developer at the start of use. Resistance is measured by a resistance measurement method to be described below. In the present invention, resistance of the carrier means resistance dynamically measured under development conditions by a magnetic brush. After replacing an aluminum electrode drum having the same dimension as that of a photosensitive drum with the photosensitive drum, supplying carrier particles onto a developing sleeve to form a magnetic brush, rubbing and contacting the magnetic brush with an electrode drum, and applying a voltage (500 V) between the sleeve and the drum, a current flowing therebetween is measured. Resistance of the carrier particles is obtained from the obtained current value using the following Equation.

$$DVR(\Omega\text{cm})=(V/I)\times(N\times L/DSD)$$

Wherein DVR is resistance of carrier (Ωcm),

V is a voltage between developing sleeve and drum (V),

I is a measured current value (A).

N is a width of developing nip (cm),

L is a length of developing sleeve (cm), and

DSD is a distance between developing sleeve and drum (cm).

In the present invention, the measurement is performed under conditions at which V=500 V, N=1 cm, L=6 cm, and DSD=0.6 mm.

Particle Diameter of Carrier

A volume average particle diameter of the carrier is preferably 10 to 100 μm, and more preferably 20 to 80 μm. The volume average particle diameter of the carrier can be measured using carrier particles separated from a developer as described above. Representatively, the volume average particle diameter can be measured by a laser diffraction type particle diameter distribution measurement device "HELOS" (manufactured by SYMPATEC) equipped with a wet disperser.

<Silica Particle Attached to Surface of Carrier>

The present invention has a feature in that silica particles having a number average particle diameter of 10 to 30 nm are attached to the surface of the carrier in an amount within the range of the following Equation (1). The above-described action mechanism works by having such a configuration, such that the effects of the invention described above can be attained.

$$5 \text{ at } \% \leq S1 \leq 10 \text{ at } \% \quad (1)$$

In the Equation (1), S1 is a concentration of silicon (Si) element as measured by XPS, and indicates an amount of silicon (and thus silica) on the surface of the carrier.

The number average particle diameter of the silica particles attached to the surface of the carrier or an amount of silicon (Si) (and thus silica) on the surface of the carrier can be obtained by a method descried in "Measurement of Amount (at %) of Silica Particles on Surface of Carrier by XPS" or "Measurement of Particle Diameter of Silica Particles (on Surface of Carrier" to be described below, after separating and recovering a carrier from a developer according to the following "Separation Method of Carrier from Developer".

[Separation Method of Carrier from Developer]

A carrier in a developer according to the present invention can be separated and recovered using an apparatus shown in FIG. 2. First, 1 g of the developer weighed with a precision balance is uniformly placed on an entire surface of a conductive sleeve 31. A voltage of 3 kV is supplied from a bias power supply 33 to the sleeve 31, and at the same time, the number of revolutions of a magnet roll 32 installed in the conductive sleeve 31 is set to be 2000 rpm. This state stands for 60 seconds, to collect a toner on a cylindrical electrode 34. After 60 seconds, a carrier remaining on the sleeve 31 is recovered, such that the carrier can be obtained by separating the toner from the developer.

[Amount (at %) of Silica Particles on Surface of Carrier by XPS]

An amount S1 of silica particles (amount (at %) of silicon) on the surface of the carrier obtained by the "Separation Method of Carrier from Developer" (an initial pre-treatment amount of silicon (and thus silica) on the carrier) is 5 to 10 at %, and preferably 6 to 9 at %, in view of adjusting a charge level and suppressing free silica particles.

[Measurement of Amount S1 (at %) of Silica Particles on Surface of Carrier by XPS]

An XPS analyzer K-α (manufactured by Thermo Fisher Scientific K.K.) was used as a measurement device. Measurement conditions: elements C, Si, Ti, Al, O, Zn, Fe, Mn and Mg are set as elements to be measured, and surface element analysis is performed under the following conditions. As a result, a concentration of Si element (and thus an amount of silica on the surface of the carrier) measured by XPS can be obtained.

(Surface Element Analysis Conditions)

Spot diameter: 400 μm

Number of Scans: 15 times

PASS Energy: 50 eV

Analysis method: Smart method

[Particle Diameter of Silica Particles on Surface of Carrier]

A number average particle diameter of silica particles attached to a surface of the carrier is 10 to 30 nm. By using (hydrophobic) silica particles having a relatively small particle diameter (number average particle diameter: 10 to 30 nm), the silica particles can be densely dispersed on the surface of the carrier, and are hardly affected by change in humidity, such that the developer has an excellent long-term storage property. When silica particles have a number average particle diameter larger than 30 nm, the silica particles attached to the surface of the carrier migrate to the toner side, which is not preferable. Further, when silica particles have a number average particle diameter smaller than 10 nm, at the time of pre-treatment, the silica particles themselves are not disintegrated but form an aggregate. In this case, silica particles to be primarily attached to the surface of the carrier migrate to the toner side, which is not preferable. In this regard, the number average particle diameter of the silica particles attached to the surface of the carrier is preferably in the range of 10 to 20 nm.

[Measurement of Particle Diameter of Silica Particle (External Additive) on Surface of Carrier]

A number average particle diameter of the silica particles to be attached to the carrier is measured as follows. A scanning electron microscope (SEM) photograph magnified 50,000 times obtained by using a scanning electron microscope (SEM) "JEM-7401F" (manufactured by JEOL Ltd.) is scanned by a scanner, silica particles on a surface of a carrier in the SEM photographic image is binarized using an image processing analyzer "LUZEX AP" (manufactured by Nireco Corp.), Feret's diameters of 100 silica particles on the surface of the carrier in a horizontal direction are calculated, and an average value thereof is determined as the number average particle diameter.

As the silica particles attached to the surface of the carrier, silica particles known in the art can be used, but as a preparation method of the silica particles attached to the surface of the carrier according to the present invention, a vapor phase method is preferable.

Since silica particles prepared by the vapor phase method have a low sphericity, they can be contacted at a plurality of points, not one point, at the time of pre-treating the carrier to attach the silica particles thereto. Therefore, it is difficult to detach the silica particles from the carrier, and thus, it is possible to suppress the silica particles from migrating to the toner side, which is preferable.

A preparation method using the vapor phase method is a method of preparing silica particles by introducing a raw material of silica particles into a high temperature flame in a vapor state or a powder state and oxidizing them. Examples of the raw material of the silica particles can include halogenated silicon such as silicon tetrachloride, organosilicon compounds, or the like.

FIG. 1 is a schematic view illustrating an example of preparation equipment for preparing silica particles by a vapor phase method using vapor. A preparation equipment for preparing silica particles according to the present invention using a vapor phase method is not limited thereto.

Specifically, in the case of preparing silica particles by the vapor phase method using vapor, the silica particles can be obtained as follows.

(1) First, a raw material is injected through a raw material inlet 1, heated in an evaporator 2, and vaporized to obtain vapor containing silicon.

(2) Next, the vapor is introduced into a mixing chamber 3 together with an inert gas such as nitrogen (not shown), dry air and/or oxygen gas, and hydrogen gas are mixed with the mixture at a predetermined ratio to obtain mixed gas, and the mixed gas is introduced from a combustion burner 4 into a combustion flame (not shown) formed in a reaction chamber 5.

(3) Silica particles are formed by combustion treatment at a temperature of 1000 to 3000° C. in the combustion flame.

(4) After cooling the generated particles in a cooler 6, a gas-state reaction product is separated and removed in a separator 7. At this time, in some cases, hydrogen chloride attached to surfaces of the particle in wet air may be removed. Further, hydrogen chloride is subjected to deacidification in a treating chamber 8, and the silica particles are collected by a filter and recovered in a silo 9.

In the preparation method as described above, a flow rate of vapor containing silicon to be introduced into a combustion flame, a combustion time, a combustion temperature, a combustion atmosphere, and other combustion conditions serve to control a particle diameter distribution of silica particles.

[Surface-Treatment of Silica Particles]

As the silica particles according to the present invention, silica particles which are subjected to surface-treatment (hydrophobic treatment) with a surface-treating agent (hydrophobic agent) are preferably used. The silica particles which are surface-treated themselves hardly adsorb moisture, and thus, a decrease in charge amount can be more effectively suppressed. Further, silica particles used as the inorganic particles, corresponding to an external additive of the toner, as well as the silica particles attached to the surface of the carrier, are both included in surface-treated silica particles to be described below.

As an example of a surface-treatment method of silica particles, the following dry method can be mentioned.

That is, a surface-treating agent is diluted with a solvent such as tetrahydrofuran (THF), toluene, ethyl acetate, methyl ethyl ketone, acetone, ethanol, and hydrogen chloride saturated ethanol, and while silica particles are forcibly stirred using a blender, or the like, the diluted solution of the surface-treating agent is added dropwise or sprayed thereto and sufficiently mixed with each other. In this case, devices such as a kneader coater, a spray dryer, a thermal processor, and a fluidized bed can be used.

Next, the obtained mixture is transferred to a vat, or the like, and heated in an oven, or the like, to be dried. Thereafter, the dried product is sufficiently disintegrated again by a mixer, a jet mill, or the like. It is preferable to classify the obtained disintegrated product as necessary. In the method as described above, when surface-treatment is performed using plural kinds of surface-treating agents, surface-treatment may be performed simultaneously using the respective surface-treating agents. Alternatively, surface-treatment may be performed using these surface-treating agents, respectively.

Further, surface-treatment may be performed using a wet method such as a method which comprises immersing silica particles in a solution of a coupling agent (surface-treating agent; a hydrophobic agent) in an organic solvent and drying the silica particles; a method which comprises dispersing composite oxide particles in water to obtain a slurry and dropping an aqueous solution of a surface-treating agent thereto, precipitating silica particles, heating and drying the silica particles, and disintegrating the silica particles, or the like, in addition to the dry method described above.

In the surface-treatment as described above, a heating temperature is preferably set to be 100° C. or more. When the heating temperature is lower than 100° C., it would be difficult to complete condensation reaction between the silica particles and the surface-treating agent.

Examples of the surface-treating agent used in the surface-treatment can include generally used surface-treating agents such as silane coupling agents, for example, hexamethyl disilazane, or the like, titanate based coupling agents, silicone oil, and silicone varnishes. Further, fluorine based silane coupling agents, fluorine based silicone oil, coupling agents having an amino group or a quaternary ammonium salt group, modified silicone oil, or the like, can also be used. It is preferable to use these surface-treating agents in a state in which they are dissolved in a solvent such as ethanol.

In the present invention, it is particularly preferable that silica particles are surface-treated with a surface-treating agent, and the surface-treating agent is a silane coupling agent having an alkyl chain and is a compound represented by the following Formula (3). As the surface-treating agent of the silica particles, the surface-treating agents known in the art can be used as described above, but preferably, the surface-treating agent is a silane coupling agent having an alkyl chain and is a compound represented by the following Formula (3). By attaching silica particles containing a surface-treating agent having a highly hydrophobic alkyl chain on a surface of carrier and a surface of toner, hydrophobicity of developer can be increased, charge retention ability between the carrier and the toner can be increased, and charge leakage can be suppressed even in a high humidity environment. Further, long-term stability of charge amount can be improved.

$$X—Si(OR)_3 \quad (3)$$

In the Formula (3), X stands for an alkyl group of 6 to 20 carbon atoms, and R stands for a methyl or an ethyl group.

In the Formula (3), X a (C6-C20) alkyl group. In order to improve stability of an initial charge amount or charge amount, X is preferably an alkyl group of 8 to 16 carbon atoms.

In the Formula (3), in view of relatively small steric hindrance, R is methyl or ethyl group. As a steric structure of R is small, the surface-treatment of the silica particles is promoted, and effects of improving chargeability can be more attained. In view of small steric hindrance, R may be a hydrogen atom, but in this case, "OR" in the Formula (3) becomes a hydroxyl group. In this case, chemical affinity between an alkoxysilane compound as the surface-treating agent and water would be increased, to generate a charge leakage point in a high temperature and high humidity environment. Therefore, in order to suppress the leakage, R should be a methyl or ethyl group. In view that surface-treatment of the silica particles is promoted and effects of improving chargeability can be more attained, R is preferably an ethyl group.

Examples of the alkoxysilane compound used as the surface-treating agent can include n-hexyltrimethoxysilane, n-hexyltriethoxysilane, n-heptyltrimethoxysilane, n-heptyltriethoxysilane, n-octyltrimethoxysilane, n-octyltriethoxysilane, n-nonyltrimethoxysilane, n-nonyltriethoxysilane, n-decyltrimethoxysilane, n-decyltriethoxysilane, n-undecyltrimethoxysilane, n-undecyltriethoxysilane, n-dodecyltrimethoxysilane, n-dodecyltriethoxysilane, n-tridecyltrimethoxysilane, n-tridecyltriethoxysilane, n-tetradecyltrimethoxysilane, n-tetradecyltriethoxysilane, n-pentadecyltrimethoxysilane, n-pentadecyltriethoxysilane, n-hexadecyltrimethoxysilane, n-hexadecyltriethoxysilane, and the like.

As the silica particles to be attached to the surface of the carrier (and the surface of the toner), silica particles known in the art can be used, but as described above, the silica particles surface-treated with the surface-treating agent are preferable. Such silica particles can be prepared by the above-described method, furthermore can be subjected to surface-treatment, and commercially available products may be also used. Specific examples of commercially available silica particles can include commercially available products R-805, R-976, R-974. R-972, R-812, R-809. R202, RX200, RY200, NAX 50, and the like, manufactured by Nippon Aerosil Co., Ltd.; commercially available products H1303VP, HVK2150, H2000, H2000T, H13TX, H30TM, H20TM, H13TM, and the like, manufactured by Clariant Co., Ltd.; and commercially available products TS-630, TG-6110, and the like, manufactured by Cabot Corporation.

As a method of attaching silica particles, a method of attaching (externally adding) the silica particles to the surface of the carrier (and the surface of the toner) using various mixing devices known in the art such as a turbula mixer, a Henschel mixer, a Nauta mixer, and a V-shaped mixer.

<<Two-Component Developer>>

A two-component developer can be formed by suitably mixing a toner and a carrier so that a content (concentration) of the toner according to the present invention is preferably 1 to 10% by mass, more preferably 4 to 8% by mass.

Examples of a mixing device used in the mixing include a Henschel mixer, a Nauta mixer, a double cone mixer, and a V-shaped mixer.

<Image Forming Method Using Two-Component Developer>

An image forming method according to the present invention is not limited as long as it is an image forming method using the two-component developer described above, and comprises forming an image forming layer on a recording medium using the toner of the two-component developer. Therefore, low-temperature fixability is excellent, a charge amount of a starter developer can be maintained for a long period of time immediately after preparation of the developer, and images having stable quality can be output for a long period of time after use.

The image forming method according to the present invention can be suitably used for a full-color image forming method using four kinds of toners composed of a black toner, a yellow toner, a magenta toner, and a cyan toner. In the full-color image forming method, any color image forming method such as a method using a four-cycle type image forming apparatus composed of four kinds of color developing devices related to yellow, magenta, cyan, and black, respectively, and one electrostatic latent image carrier (also referred to as "electrophotographic photosensitive material" or simply "photosensitive material"), or a method using a tandem type image forming apparatus in which an image forming unit having a color developing device of each color and an electrostatic latent image carrier is mounted separately for each color, can be used.

As the color image forming method, an image forming method including a fixing process using a heat pressure fixing system capable of performing the heating while applying pressure can be preferably used.

Specifically, in this color image forming method, for example, an electrostatic latent image formed on a photosensitive material is developed by using the toner to obtain a toner image, and this toner image is transferred to an image support, and the toner image transferred onto the image support is fixed on the image support by a fixing process using a heat pressure fixing system, whereby a printed matter on which a visible image is formed can be obtained.

It is preferable to simultaneously perform pressure application and heating in the fixing process. Alternatively, first, pressure may be applied and then heating may be performed.

Further, the image forming method according to the present invention can be preferably used in an image forming method using a heat pressure fixing system. As a fixing device using the heat pressure fixing system used in the image forming method according to the present invention, various fixing devices known in the art can be used. Hereinafter, as the heat pressure fixing device, a heating roller type fixing device and a belt heating type fixing device will be described.

(i) Heating Roller Type Fixing Device

The heating roller type fixing device generally has a pair of rollers composed of a heating roller and a pressure roller in contact with the heating roller. In the fixing device, the pressure roller is deformed by a pressure applied between the heating roller and the pressure roller, so that a so-called fixing nip portion is formed in this deformed portion.

Generally, in the heating roller, a heat source such as a halogen lamp is disposed and installed inside a core metal made of a hollow metal roller made of aluminum, or the like. The core metal is heated by the heat source. In this case, a temperature is adjusted by controlling electrical conduction to the heat source so that a temperature of an outer peripheral surface of the heating roller is maintained at a predetermined fixation temperature.

In the case where the fixing device is used in an image forming apparatus for forming a full color image which is required to have an ability to sufficiently heat and melt toner images composed of four toner layers (yellow, magenta, cyan, and black) to mix colors, it is preferable that the fixing device has the following configuration. That is, the fixing device preferably includes a core metal having a high heat capacity as a heating roller in which an elastic layer for uniformly melting a toner image is formed on an outer peripheral surface of the core metal.

Further, the pressure roller has an elastic layer made of a soft rubber such as urethane rubber, silicone rubber, or the like.

The pressure roller may include a core metal made of a hollow metal roller made of aluminum, or the like, and having an elastic layer formed on an outer peripheral surface of the core metal.

Further, when the pressure roller has the core metal, a heat source such as a halogen lamp may also be disposed and installed inside the core metal similarly to the heating roller. The core metal may be heated by the heat source, and a temperature is adjusted by controlling electrical conduction to the heat source so that a temperature of an outer peripheral surface of the pressure roller is maintained at a predetermined fixation temperature.

As the heating roller and/or the pressure roller, it is preferable to use a roller in which a release layer made of a fluoride resin such as polytetrafluoroethylene (PTFE), a tetrafluoroethylene-perfluoroalkyl vinyl ether copolymer (PFA), or the like, is formed as an outermost layer thereof.

In this heating roller type fixing device, the heating by the heating roller and application of pressure in the fixing nip portion can be performed by rotating the pair of rollers to sandwich and convey an image support on which a visible image will be formed at the fixing nip portion. As a result, an unfixed toner image is fixed on the image support.

By the image forming method according to the present invention, a charge amount of a starter developer can be maintained for a long period of time immediately after preparation of the developer, and furthermore, after the use, images can be stably output for a long period of time, and low-temperature fixability can be also good. Therefore, in the heating roller type fixing device, a temperature of the heating roller can be set to be comparatively low, specifically 150° C. or less. Further, the temperature of the heating roller is preferably 140° C. or less, and more preferably 135° C. or less. In view of excellent low-temperature fixability, the lower the temperature of the heating roller, the more preferable, and a lower limit value thereof is not particularly limited, but is substantially about 90° C.

(ii) Belt Heating Type Fixing Device

A belt heating type fixing device generally includes a heating member made of, for example, a ceramic heater, a pressure roller, and a fixing belt made of a heat resistant belt interposed between the heating member and the pressure roller, wherein the pressure roller is deformed by a pressure applied between the heating member and the pressure roller so that a so-called fixing nip portion is formed in this deformed portion.

As the fixing belt, a heat resistant belt and sheet, and the like, which are made of polyimide, or the like, may be used. Further, the fixing belt may have a heat resistant belt and sheet, and the like, which are made of polyimide, or the like, as a substrate, and a release layer made of a fluoride resin such as polytetrafluoroethylene (PTFE) or a tetrafluoroethylene-perfluoroalkylvinylether copolymer (PFA) which is formed on the substrate. The fixing belt may additionally have an elastic layer made of rubber, or the like, installed between the substrate and the release layer.

In the belt heating type fixing device as described above, an image support loaded with an unfixed toner image is sandwiched and conveyed together with the fixing belt between the fixing belt forming the fixing nip portion and the pressure roller. Therefore, the heating by the heating member via the fixing belt and application of pressure at the fixing nip portion are performed, and the unfixed toner image is fixed on the image support.

According to the belt heating type fixing device as described above, the heating member may be electrically conducted so as to generate heat at a predetermined fixation temperature only at the time of image formation. Therefore, it is possible to shorten a waiting time from when the image forming apparatus is powered on until the image formation can be executed. In addition, power consumption of the image forming apparatus at the time of standby is extremely small, such that power saving can be achieved.

As described above, the heating member, the pressure roller, and the fixing belt used as fixing members in the fixing process preferably have a plurality of layers.

In the belt heating type fixing device, a temperature of the heating member can be set to be comparatively low, specifically 150° C. or less. Further, the temperature of the heating member is preferably 140° C. or less, and more preferably 135° C. or less. In view of excellent low-temperature fixability, the lower the temperature of the heating member, the more preferable, and a lower limit value thereof is not particularly limited, but is substantially about 90° C.

(Recording Medium)

A recording medium (also referred to as an image support, a recording material, recording paper, a recording sheet, etc.) may be one generally used and is not particularly limited as long as it can maintain a toner image formed by an image forming method known in the art, for example, using an image forming apparatus. Examples of usable recording media can include plain paper including thin paper and thick paper, high quality paper, art paper, coated printing paper such as coated paper, commercially available Japanese paper or post card paper, plastic film for OHP, fabrics, various resin materials used for so-called soft packaging, or resin films made of various resin materials in a film form, and labels.

Further, the embodiments of the present invention are not limited to the above-described embodiments, and may be modified as needed within the scope of the present invention.

Example

Hereinafter, the embodiments of the present invention will be described concretely with reference to Examples, but the present invention is not limited thereto. In the following Examples, unless otherwise specified, the terms "part" and "%" mean "part by mass" and "% by mass", respectively, and each operation was performed at room temperature (25° C.).

<<1. Preparation Method of Toner>>

<1-1. Synthesis of Crystalline Polyester Resin>

(1-1-1. Synthesis of Crystalline Polyester Resin 1)

After 281 parts of tetradodecanedioic acid as a polyvalent carboxylic acid compound corresponding to a raw material of a crystalline polyester polymerized segment and 283 parts of 1,6-hexanediol as a polyhydric alcohol compound were put into a reaction vessel equipped with a nitrogen introduction pipe, a dehydration pipe, a stirrer, and a thermo couple, the mixture was dissolved by being heated to 160° C. Meanwhile, a pre-mixed solution containing 23.5 parts of styrene, 6.5 parts of n-butyl acrylate, 2.5 parts of dicumyl peroxide, which are raw materials of a vinyl polymerized segment, and 2 parts of acrylic acid as a bireactive monomer was added dropwise thereto for 1 hour through a dropping funnel. After polymerizing styrene, n-butyl acrylate, and acrylic acid by continuously stirring the mixture for 1 hour while a temperature was maintained to 170° C. 2.5 parts of tin (II) 2-ethylhexanoate and 0.2 parts of gallic acid were added thereto, heated to 210° C., and reacted for 8 hours. The reaction was further performed for 1 hour at 8.3 kPa, thereby obtaining a hybridized crystalline polyester resin 1. An introduction amount of a hybrid portion (styrene-acryl polymerized segment) was about 5.0%.

(1-1-2. Synthesis of Crystalline Polyester Resin 2)

After 281 parts of decanedioic acid as a polyvalent carboxylic acid compound and 283 parts of 1,6-hexanediol as a polyhydric alcohol compound were put into a reaction vessel equipped with a nitrogen introduction pipe, a dehydration pipe, a stirrer, and a thermo couple, the mixture was dissolved by being heated to 160° C. After 2.5 parts of tin (II) 2-ethylhexanoate and 0.2 parts of gallic acid were added thereto, a temperature was raised to 210° C., and reacted for 8 hours. The reaction was further performed again for 1 hour at 8.3 kPa, thereby obtaining a crystalline polyester resin 2.

<1-2. Preparation of Crystalline Resin Particle Dispersion>

(1-2-1. Preparation of Crystalline Resin Particle Dispersion 1)

100 parts of the obtained crystalline polyester resin 1 was dissolved in 400 parts of ethyl acetate. Then, 25 parts of a 5.0% aqueous sodium hydroxide solution was added thereto, thereby preparing a crystalline resin solution. The crystalline resin solution was put into a vessel equipped with a stirrer, and 638 pans of a 0.26% aqueous sodium lauryl sulfate solution was added dropwise thereto and mixed therewith for 30 minutes while the crystalline resin solution was stirred. During the dropwise addition of the aqueous sodium lauryl sulfate solution, a liquid in the reaction vessel became cloudy. After a total amount of the aqueous sodium lauryl sulfate solution was added dropwise, an emulsion in which crystalline resin particles were uniformly dispersed was prepared. Then, the emulsion was heated to 40° C. and ethyl acetate was removed by distillation under reduced pressure of 150 hPa using a diaphragm type vacuum pump "V-700" (manufactured by BUCHI), thereby obtaining a crystalline resin particle dispersion 1 in which crystalline resin particles made of the polyester resin were dispersed.

(1-2-2. Preparation of Crystalline Resin Particle Dispersion 2)

A crystalline resin particle dispersion 2 was obtained in the same manner as in "1-2-1. Preparation of crystalline resin particle dispersion 1" except for using the crystalline polyester resin 2 instead of the crystalline polyester resin 1.

<1-3. Preparation of Amorphous Resin Particle Dispersion>

(1-3-1. Preparation of Amorphous Resin Particle Dispersion 1)

First Stage Polymerization

A solution prepared by dissolving 4 parts of polyoxyethylene (2) dodecyl ether sodium sulfate in 3000 parts of ion-exchange water was charged in a reaction vessel equipped with a stirrer, a temperature sensor, a cooling pipe, and a nitrogen introduction device, and an internal temperature was raised to 80° C. while the solution was stirred at a stirring rate of 230 rpm under airflow of nitrogen. After raising the temperature, a solution obtained by dissolving 10 parts of potassium persulfate in 200 parts of ion-exchange water was added thereto, a temperature of the solution was adjusted to 75° C., and a monomer mixture composed of 584 parts of styrene, 160 parts of n-butyl acrylate and 56 parts of methacrylic acid was added dropwise thereto for 1 hour. Then, a dispersion of resin particles [b1] was prepared by performing polymerization while heating and stirring the mixture at 75° C. for 2 hours.

Second Stage Polymerization

A solution prepared by dissolving 2 parts of polyoxyethylene (2) dodecyl ether sodium sulfate in 3000 parts of ion-exchange water was charged in a reaction vessel equipped with a stirrer, a temperature sensor, a cooling pipe, and a nitrogen introduction device, and an internal temperature was raised to 80° C. Then, a solution obtained by dissolving 42 parts (in terms of solid content) of the dispersion of the resin particles [b1] obtained above and 70 parts of microcrystalline wax "HNP-0190" (Nippon Seiro Co., Ltd.) in a monomer mixture composed of 239 parts of styrene, 111 parts of n-butyl acrylate, 26 parts of methacrylic acid and 3 parts of n-octyl mercaptan at 80° C. was added thereto. Then, the mixture was mixed and dispersed for 1 hour using a mechanical disperser "CLEARMIX" (manufactured by M Technique Co., Ltd.) having a circulation path, thereby preparing a dispersion containing emulsified particles (oil droplets).

Then, an initiator solution prepared by dissolving 5 parts of potassium persulfate in 100 parts of ion-exchange water was added to this dispersion, and this system was heated and stirred at 80° C. for 1 hour to perform polymerization, thereby preparing a dispersion of resin particles [b2].

Third Stage Polymerization

A solution prepared by dissolving 10 parts of potassium persulfate in 200 parts of ion-exchange water was added to the dispersion of the resin particles [b2] obtained above, and a monomer mixture composed of 380 parts of styrene, 132 parts of n-butyl acrylate, 39 parts of methacrylic acid and 6 parts of n-octyl mercaptan was added dropwise thereto at 80° C. for 1 hour. After completion of the dropwise addition, polymerization was carried out by heating and stirring the mixture for 2 hours, followed by cooling to 28° C., thereby preparing an amorphous resin particle dispersion 1.

<1-4. Preparation of Colorant Particle Dispersion [Bk]>

90 g of sodium dodecylsulfate was dissolved in 1600 g of ion-exchange water while stirring. A colorant particle dispersion [Bk] was prepared by slowly adding 420 g of carbon black "REGAL 330R" (manufactured by Cavot) to the resultant solution while stirring, and subjecting the resultant mixture to dispersion treatment using a stirrer "CLEARMIX" (manufactured by M Technique Co., Ltd.).

A particle diameter of the colorant particles in the colorant particle dispersion [Bk] was measured using an electrophoretic light scattering photometer "ELS-800" (manufactured by Otsuka Electronics Co., Ltd.), and as a result, the particle diameter was found to be 110 nm.

<1-5. Preparation of Toner>

(1-5-1. Preparation of Toner 1)

<Aggregation•Fusion Process>

300 parts (in terms of solid content) of the amorphous resin particle dispersion 1, 34 parts (in terms of solid content) of the crystalline resin particle dispersion 1, 1100 parts of ion-exchange water, and 40 parts (in terms of solid content) of the colorant particle dispersion [Bk] were put into a reaction vessel equipped with a stirrer, a temperature sensor, a cooling pipe, and a nitrogen introduction device, a temperature of the solution was adjusted to 30° C. Then, a 5N aqueous sodium hydroxide solution was added thereto to adjust a pH to 10. Next, an aqueous solution obtained by dissolving 60 parts of magnesium chloride in 60 parts of ion-exchange water was added at 30° C. for 10 minutes while stirring the mixture. After holding for 3 minutes, the heating started to raise a temperature of this system to 85° C. for 60 minutes, to induce aggregation of particles while maintaining the temperature at 85° C., such that a particle growth reaction was continued. In this state, a particle diameter of the aggregated particles was measured using the "Coulter Multisizer 3" (manufactured by Beckman Coulter, Inc.), and when a volume-based median diameter reached 6 μm, an aqueous solution obtained by dissolving 40 parts of sodium chloride in 160 parts of ion-exchange water was added thereto to stop particle growth. Further, a dispersion of toner base particles 1 was prepared by heating and stirring the resultant at a temperature (solution temperature) of 80° C. for 1 hour to perform fusion between the particles as an aging process.

<Washing•Drying Process>

The dispersion of the toner base particles 1 prepared as described above was subjected to solid-liquid separation using a basket type centrifugal separator "MARKIII Model No. 60×40+M" (manufactured by Matsumoto Kikai Co., Ltd.), thereby forming a wet cake of the toner base particles. The wet cake was washed with ion-exchange water at 40° C. using the basket type centrifugal separator until electric conductivity of a filtrate reached 5 μS/cm. Thereafter, the wet cake was transferred to a "Flash Jet Dryer" (manufactured by SEISHIN ENTERPRISE Co., Ltd.) and dried until a content of water became 0.5%, thereby preparing toner base particles 1.

<External Additive Addition Process>

A toner 1 was prepared by adding 0.6 parts of hydrophobic silica (number average particle diameter=12 nm), 0.9 parts of hydrophobic silica (number average particle diameter=30 nm), and 0.6 parts of hydrophobic titania (number average particle diameter=20 nm) to 100 parts of the toner base particles 1 and mixing the mixture was using a Henschel mixer. As a result of confirming a domain-matrix structure, a domain (phase) of the crystalline polyester resin was confirmed. As the hydrophobic silica (number average particle diameter=12 nm), the same inorganic particles as inorganic particles 1 in the following Table 2 were used. As the hydrophobic silica (number average particle diameter=30 nm), the same inorganic particles as inorganic particles 3 in the following Table 2 were used. As the hydrophobic titania (number average particle diameter=20 nm), the same inorganic particles as inorganic particles 5 in the following Table 2 were used. An amount S2 of the silica on the surface of the toner in Equation (2) is an amount of silica including all the hydrophobic silica (number average particle diameter=30 nm) and the hydrophobic silica (number average particle diameter=12 nm).

(1-5-2. Preparation of Toner 2)

A toner 2 was prepared in the same manner as preparation of the toner 1 except for using the crystalline resin particle dispersion 2 instead of the crystalline resin particle dispersion 1 used in preparation of the toner 1 to prepare a dispersion of toner base particles 2. However, at the time of cooling the dispersion, the dispersion was injected into and quenched in 5000 parts of ion-exchange water. As a result of confirming a domain-matrix structure similarly to the toner 1, a domain (phase) of the crystalline polyester was not observed in the toner 2.

(1-5-3. Preparation of Toner 3)

A toner 3 was prepared in the same manner as preparation of the toner 1 except for changing an amount of the hydrophobic silica (number average particle diameter=12 nm) from 0.6 part to 0.45 part in preparation of the toner 1. As a result of confirming a domain-matrix structure similarly to the toner 1, a domain (phase) of the crystalline polyester was confirmed in the toner 3.

(1-5-4. Preparation of Toner 4)

A toner 4 was prepared in the same manner as preparation of the toner 1 except for changing an amount of the hydrophobic silica (number average particle diameter=12 nm) from 0.6 part to 0.75 part in preparation of the toner 1. As a result of confirming a domain-matrix structure similarly to the toner 1, a domain (phase) of the crystalline polyester was confirmed in the toner 4.

(1-5-5. Preparation of Toner 5)

A toner 5 was prepared in the same manner as preparation of the toner 1 except for changing an amount of the hydrophobic silica (number average particle diameter=12 nm) from 0.6 part to 0.4 part in preparation of the toner 1. As a result of confirming a domain-matrix structure similarly to the toner 1, a domain (phase) of the crystalline polyester was confirmed in the toner 5.

(1-5-6. Preparation of Toner 6)

A toner 6 was prepared in the same manner as preparation of the toner 1 except for changing an amount of the hydrophobic silica (number average particle diameter=12 nm) from 0.6 part to 0.8 part in preparation of the toner 1. As a result of confirming a domain-matrix structure similarly to the toner 1, a domain (phase) of the crystalline polyester was confirmed in the toner 6.

TABLE 1

| Toner No. | Base Particle No. | Crystalline Polyester Particle No. | Domain | Amount S2 (at %) of Silica on Surface of Toner Amount (at %) of Si Element |
|---|---|---|---|---|
| 1 | 1 | Crystalline Polyester 1 | Presence | 12.2 |
| 9 | 9 | Crystalline Polyester 2 | Absence | 12.2 |
| 3 | 1 | Crystalline Polyester 1 | Presence | 10.0 |
| 4 | 1 | Crystalline Polyester 1 | Presence | 13.9 |
| 5 | 1 | Crystalline Polyester 1 | Presence | 9.5 |
| 6 | 1 | Crystalline Polyester 1 | Presence | 14.5 |

<<2. Preparation Method of Carrier>>

<2-1. Preparation of Carrier Particle>

(2-1-1. Preparation of Core Material)

Suitable amounts of respective raw materials were mixed so that contents of the respective raw materials in terms of MnO, MgO, SrO, and $Fe_2O_3$ were 19.0 mol %, 2.8 mol %, 1.5 mol %, and 75.0 mol % respectively, and water was added thereto. Then, the mixture was pulverized using a wet ball mill for 10 hours, mixed, and dried. Slurry pulverized for 24 hours using the wet ball mill after being maintained at 950° C. for 4 hours was granulated and dried, added in a sintering furnace equipped with a stirrer in an amount corresponding to 50% of a volume, maintained at 1300° C. and a peripheral speed of 10 m/s for 4 hours, and then, disintegrated to adjust a particle diameter to so as to give a volume average particle diameter of 33 μm, thereby obtaining a core material. The volume average particle diameter of the core material (carrier core particle) is a volume-based average particle diameter measured by a laser diffraction type particle diameter distribution measurement device "HELOS" (manufactured by SYMPATEC) equipped with a wet disperser.

(2-1-2. Preparation of Carrier Particle)

100 parts of the core material prepared above and 3.5 parts of copolymer resin particles of cyclohexyl methacrylate/methyl methacrylate (copolymerization ratio: 5/5) were charged into a high-speed mixer with stirring blades, and stirred and mixed with each other at 125° C. for 45 minutes at a wind speed of 10 m/s, to form a coating layer on a surface of the core material under the action of mechanical impact force. Thereafter, the wind speed was decreased to 2 m/s and the coating layer was cooled, thereby preparing a "carrier particle" coated with the coating resin. Resistance was $2.2\times10^{10}$ Ω·cm.

<2-2. Inorganic Particle Attached to Surface of Carrier>

As an inorganic particle attached to a surface of the carrier, commercially available inorganic particles 1 to 7 illustrated in the following Table 2 were used.

TABLE 2

| Inorganic particle forcarrier treament No. | Kind of particles | Commercially available product | Number average particle diameter | Kind of surface-treating agent |
|---|---|---|---|---|
| Inorganic particle 1 | Silica particle | R805 (Product manufactured by Aerosil Co., Ltd.) | 12 nm | Octyl silane |
| Inorganic particle 2 | Silica particle | NX90 (Product manufactured by Aerosil Co., Ltd.) | 20 nm | Hexamethyl disilazane |
| Inorganic particle 3 | Silica particle | NAX50 (Product manufacturedbv Aerosil Co., Ltd.) | 30 nm | Hexamethyl disilazane |
| Inorganic particle 4 | Silica particle | RX200 (Product manufactured by Aerosil Co., Ltd.) | 12 nm | Hexamethyl disilazane |
| Inorganic particle 5 | Titania particle | ST550 (Product manufactured by Titan Kogyo, Ltd.) | 20 nm | Isobutyl silane |
| Inorganic particle 6 | Silica particle | RX50 (Product manufactured by Aerosil Co., Ltd.) | 40 nm | Hexamethyl disilazane |
| Inorganic particle 7 | Alumina Particle | C805 (Product manufactured by Aerosil Co., Ltd.) | 12 nm | Octyl silane |

<<3. Preparation Method of Developer>>

<3.1. Preparation of Developer 1>

After weighing and injecting 1.0 kg of the carrier prepared as described above and 0.46 g of the inorganic particle 1 illustrated in Table 2 into a micro type V-shaped mixer (manufactured by Tsutsui Scientific Instruments Co., Ltd.), respectively, the mixture was mixed at a rotation speed of 45 rpm for 30 minutes, and the toner 1 was added thereto so that a concentration of the toner became 6.5% by mass, followed by mixing for 30 minutes, thereby preparing a developer 1.

<3-2. to 3-16. Preparation of Developers 2 to 16>

Developers 2 to 16 were prepared using combinations illustrated in the following Table 3, respectively, in the same manner as in preparation of the developer 1 except for changing the kind and addition amount of inorganic particles mixed with the carrier and the toner in preparation of developer 1.

TABLE 3

| | | | Starter developer pre-treatment particle | | | | | | | | Silica amount |
|---|---|---|---|---|---|---|---|---|---|---|---|
| | Developer No. | Carrier No. | Inorganic particle No. | Kind | Particle diameter | Kind of element | Surface-treating agent | Pre-treating amount in Carrier (g/kg of carrier) | Amount of silica on surface of carrier S1 at % (Ti, Al) | Toner No. | in Toner S2 at % Amount of Si element (at %) |
| Example | 1 | 1 | 1 | Silica particle | 12 nm | Si | Octyl silane | 0.46 | 10.0 | 1 | 12.2 |
| | 2 | 2 | 1 | Silica particle | 12 nm | Si | Octyl silane | 0.30 | 6.5 | 1 | 12.2 |
| | 3 | 3 | 1 | Silica particle | 12 nm | Si | Octyl silane | 0.23 | 5.0 | 1 | 12.2 |
| | 4 | 4 | 2 | Silica particle | 20 nm | Si | Octyl silane | 0.45 | 6.2 | 1 | 12.2 |
| | 5 | 5 | 3 | Silica particle | 30 nm | Si | Hexamethyl disilazane | 0.50 | 6.3 | 1 | 12.2 |
| | 6 | 2 | 1 | Silica particle | 12 nm | Si | Octyl silane | 0.30 | 6.5 | 2 | 12.2 |
| | 7 | 2 | 1 | Silica particle | 12 nm | Si | Octyl silane | 0.30 | 6.5 | 3 | 10.0 |
| | 8 | 2 | 1 | Silica particle | 12 nm | Si | Octyl silane | 0.30 | 6.5 | 4 | 13.9 |
| | 9 | 6 | 4 | Silica particle | 12 nm | Si | Hexamethyl disilazane | 0.30 | 6.5 | 1 | 12.2 |
| | 10 | 1 | 1 | Silica particle | 12 nm | Si | Octyl silane | 0.30 | 6.5 | 5 | 9.5 |
| | 11 | 1 | 1 | Silica particle | 12 nm | Si | Octyl silane | 0.30 | 6.5 | 6 | 14.5 |
| Comparative Example | 12 | 7 | 1 | Silica particle | 12 nm | Si | Octyl silane | 0.55 | 12.0 | 1 | 12.2 |
| | 13 | 8 | 1 | Silica particle | 12 nm | Si | Octyl silane | 0.20 | 4.5 | 1 | 12.2 |
| | 14 | 9 | 5 | Titania particle | 20 nm | Ti | Isobutyl silane | 0.40 | 5.7 | 1 | 12.2 |
| | 15 | 10 | 6 | Silica particle | 40 nm | Si | Hexamethyl disilazane | 0.90 | 6.5 | 1 | 12.2 |
| | 16 | 11 | 7 | Alumina particle | 13 nm | Al | Octyl silane | 0.40 | 5.9 | 1 | 12.2 |

Note)
For Comparative Examples 14 and 16 in Table 3, the "Amount of silica on surface of carrier" shall be read as "Amount of titania on surface of carrier" or "Amount of alumina on surface of carrier", respectively.

<<Evaluation Method>>

[Evaluation 1: Charge Stability (Variation after Standing)]

Under room temperature and normal pressure (20CC, RH 50%) environmental conditions, (1) at the time of preparing a developer (immediately after preparation) and (2) after standing a developer for 2 weeks from the preparation of the developer, a band-shaped solid image with a printing ratio of 5% as a test image was printed on one sheet (1 p) of A4-size high quality paper (65 g/m$^2$). A charge amount of the toner after the printing at the time of preparing the developer and after standing the developer for 2 weeks were measured, respectively, and evaluated according to the following Evaluation criteria. After sampling a two-component developer in a developing device, a charge amount was measured using a blow-off charge amount measurement device "TB-200" (Manufactured by Toshiba Chemical Corp.).

—Evaluation Criteria—

A: A change value Δ between charge amounts of the toner at the time of preparing the developer and after standing the developer for 2 weeks was less than 4 μC/g; pass (excellent; ⊙)

B: A change value Δ between charge amounts of the toner at the time of preparing the developer and after standing the developer for 2 weeks was 4 μC/g or more to less 8 μC/g; pass (possible; ○)

C: A change value Δ between charge amounts of the toner at the time of preparing the developer and after standing the developer for 2 weeks was 8 μC/g or more; fail (impossible; x)

[Evaluation 2: Charge Stability (Duration variation)]

Under room temperature and normal pressure (20° C., RH 50%) environmental conditions, after preparing a developer and standing the developer for 2 weeks, a band-shaped solid image with a printing ratio of 5% as a test image was printed on 300,000 sheets of A4-size high quality paper (65 g/m$^2$). A charge amount of the toner at an initial stage of printing (after printing the image on one sheet (1 p) of paper) and a charge amount after printing the image on 300,000 sheets (300 kp) of paper were measured and evaluated according to the following evaluation criteria. After sampling a two-component developer in a developing device, a charge amount was measured using a blow-off charge amount measurement device "TB-200" (Manufactured by Toshiba Chemical Corp.).

—Evaluation Criteria—

A: A change value Δ between charge amounts of the toner at the initial stage of printing and after printing the image on 300,000 sheets of paper was less than 4 μC/g; pass (excellent; ⊙)

B: A change value Δ between charge amounts of the toner at the initial stage of printing and after printing the image on 300,000 sheets of paper 4 μC/g or more to less than 8 μC/g; pass (possible; ○)

C: A change value Δ between charge amounts of the toner at the initial stage of printing and after printing the image on 300,000 sheets of paper was 8 μC/g or more; fail (impossible; x)

[Evaluation 3: Image Quality (Grainness)]

Under room temperature and normal pressure (20° C., RH 50%) environmental conditions, after preparing a developer and standing the developer for 2 weeks, a band-shaped solid image with a printing ratio (CW) of 5% as a test image was printed on 300,000 sheets of A4-size high quality paper (65 g/m$^2$). At an initial stage of printing (after printing the image on one sheet (1 p) of paper) and after printing the image on 300,000 sheets (300 kp) of paper, a gradation pattern with a gradation rate of 32 stages was printed, and graininess of this gradation pattern was evaluated according to the following evaluation criteria. At the time of evaluating graininess, Fourier transform was performed on a read value of the gradation pattern by CCD in consideration of modulation transfer function (MTF) correction, and a graininess index (GI) value depending on human's relative luminous efficiency was measured, and graininess was evaluated using a maximum GI value. The smaller the GI value, the more preferable. Further, the GI value is a value disclosed in Journal of the Japanese Institute of Image Science, 39 (2), 84-93 (2000).

—Evaluation Criteria—

A: At the initial stage of printing and after printing the image on 300,000 sheets of paper, the GI value was less than 0.18 and a change value Δ therebetween was 0.02 or less; pass (excellent; ⊙)

B: At the initial stage of printing and after printing the image on 300,000 sheets of paper, the GI value was 0.18 or more to less than 0.20 and the change value Δ therebetween was 0.02 or less; pass (good; ○)

C: At the initial stage of printing and after printing the image on 300,000 sheets of paper, the GI value was 0.20 or more to less than 0.22 and the change value Δ therebetween was more than 0.02 to 0.04 or less; pass (possible; Δ)

D: At least one of the GI values at the initial stage of printing and after printing the image on 300,000 sheets of paper was 0.22 or more (the change value Δ therebetween was also 0.04 or more); fail (impossible; x)

From the results shown in Table 4, it can be noted that the developers 1 to 11 in Examples having the configuration according to the present invention can achieve both the charge stability (variation after standing and duration variation) and the image quality (GI value).

Meanwhile, it can be noted that in the developers 12 to 16 in Comparative Examples, it was difficult to achieve both the charge stability (variation after standing and duration variation) and the image quality (GI value) as in the related art.

Although embodiments of the present invention have been described and illustrated in detail, the disclosed embodiments are made for the purpose of illustration and example only and not limitation. The scope of the present invention should be interpreted by terms of the appended claims.

What is claimed is:

1. A two-component developer for developing an electrostatic charge image, the two-component developer comprising a toner and a carrier, wherein the toner contains an amorphous resin and a crystalline resin as binder resins and an inorganic particle as an external additive particle, and the carrier has a surface to which silica particles having a number average particle diameter of 10 to 30 nm are attached in an amount in the range of the following Equation (1):

$$5 \text{ at } \% \leq S1 \leq 10 \text{ at } \% \quad (1)$$

wherein S1 represents a concentration of Si element as measured by XPS and indicates an amount of silica on the surface of the carrier.

2. The two-component developer according to claim 1, wherein the inorganic particle comprises the silica particle and is attached in an amount in the range of the following Equation (2):

$$10 \text{ at } \% \leq S2 \leq 14 \text{ at } \% \quad (2)$$

TABLE 4

| | | Charge stability | | | | | | | | Image quality (GI Value) | | | |
|---|---|---|---|---|---|---|---|---|---|---|---|---|---|
| | | Variation after standing | | | | Duration variation | | | | Initial | | | |
| | Developer | At the time of preparing developer 1pCW5% | After standing for 2 weeks 1pCW5% | Δ | Evaluation | Initial (after standing for 2 weeks) 1pCW5% | 300 kp CW5% | Δ | Evaluation | (after standing for 2 weeks) 1pCW5% | 300 kp CW5% | Change value Δ CW5% | Evaluation |
| Example | 1 | 48.6 | 47.7 | 0.9 | A | 47.7 | 48.5 | 0.8 | A | 0.18 | 0.19 | 0.01 | B |
| | 2 | 52.3 | 50.9 | 1.4 | A | 50.9 | 52.3 | 1.4 | A | 0.17 | 0.16 | 0.01 | A |
| | 3 | 55.0 | 53.1 | 1.9 | A | 53.1 | 50.1 | 3.0 | A | 0.17 | 0.18 | 0.01 | B |
| | 4 | 52.9 | 50.9 | 2 | A | 50.9 | 48.1 | 2.8 | A | 0.17 | 0.19 | 0.02 | B |
| | 5 | 53.2 | 50.9 | 2.3 | A | 50.9 | 47.0 | 3.9 | A | 0.17 | 0.19 | 0.02 | B |
| | 6 | 52.6 | 48.5 | 4.1 | B | 48.5 | 44.3 | 4.2 | B | 0.17 | 0.20 | 0.03 | C |
| | 7 | 49.6 | 46.5 | 3.1 | A | 46.5 | 48.5 | 2.0 | A | 0.17 | 0.20 | 0.03 | C |
| | 8 | 53.0 | 52.4 | 0.6 | A | 52.4 | 47.8 | 4.6 | B | 0.17 | 0.20 | 0.03 | C |
| | 9 | 52.7 | 48.5 | 4.2 | B | 48.5 | 46.0 | 2.5 | A | 0.17 | 0.20 | 0.03 | C |
| | 10 | 46.5 | 41.0 | 5.5 | B | 41.0 | 46.0 | 5.0 | B | 0.19 | 0.21 | 0.02 | C |
| | 11 | 55.6 | 50.3 | 5.3 | B | 50.3 | 45.3 | 5.0 | B | 0.17 | 0.21 | 0.04 | C |
| | 12 | 43.0 | 36.7 | 6.3 | B | 36.7 | 26.5 | 10.2 | C | 0.19 | 0.23 | 0.04 | D |
| Comparative Example | 13 | 60.0 | 57.0 | 3.0 | A | 57.0 | 44.3 | 12.7 | C | 0.17 | 0.22 | 0.05 | D |
| | 14 | 45.0 | 32.3 | 12.7 | C | 32.3 | 27.5 | 4.8 | B | 0.21 | 0.25 | 0.04 | D |
| | 15 | 48.0 | 42.1 | 5.9 | B | 42.1 | 33.8 | 8.3 | C | 0.18 | 0.23 | 0.05 | D |
| | 16 | 35.5 | 22.5 | 13.0 | C | 22.5 | 11.0 | 11.5 | C | 0.24 | 0.30 | 0.06 | D |

wherein S2 represents a concentration of Si element as measured by XPS and indicates an amount of silica on the surface of the toner.

3. The two-component developer according to claim 1, wherein the silica particle is a silica particle surface-treated with a surface-treating agent, and the surface-treating agent is a silane coupling agent represented by the following Formula (3):

$$X—Si(OR)_3 \quad (3)$$

wherein X is a C6-C20 alkyl group, and R is a methyl or an ethyl group.

4. The two-component developer according to claim 1, wherein the toner has a domain-matrix structure, said matrix containing the amorphous resin and said domain containing a crystalline polyester resin.

5. The two-component developer according to claim 1, wherein the amorphous resin contains a styrene-acrylic resin.

6. An image forming method using the two-component developer set forth in claim 1.

* * * * *